US005819657A

United States Patent [19]

Rossini

[11] Patent Number: 5,819,657

[45] Date of Patent: Oct. 13, 1998

[54] AIR CARRIER SPACER SLEEVE FOR A PRINTING CYLINDER

[75] Inventor: Felice Rossini, Milan, Italy

[73] Assignee: Ermino Rossini, spa, Milan, Italy

[21] Appl. No.: 939,536

[22] Filed: Sep. 29, 1997

Related U.S. Application Data

[63] Continuation-in-part of Ser. No. 613,895, Mar. 11, 1996.

[30] Foreign Application Priority Data

Sep. 26, 1997 [IT] Italy ..... MI97A2194

[51] Int. Cl.[6] ..... B41F 13/16

[52] U.S. Cl. ..... 101/376; 101/375

[58] Field of Search ..... 101/383, 389.1, 101/375, 376, 217; 492/4, 5

[56] References Cited

U.S. PATENT DOCUMENTS

| | | |
|---|---|---|
| 2,365,980 | 12/1944 | Thomas . |
| 3,015,268 | 1/1962 | Garrett . |
| 3,043,211 | 7/1962 | Appenzeller . |

(List continued on next page.)

FOREIGN PATENT DOCUMENTS

| | | |
|---|---|---|
| 278017A1 | 8/1988 | European Pat. Off. . |
| 384104B1 | 9/1994 | European Pat. Off. . |
| 623466A3 | 11/1994 | European Pat. Off. . |
| A1229548 | 12/1966 | Germany . |
| 8532300 U | 2/1986 | Germany . |
| A3525045 | 1/1987 | Germany . |
| 1188238 | of 1988 | Italy . |
| 57-107845 | 7/1982 | Japan . |

OTHER PUBLICATIONS

Werbeprospekt der Einsprechenden zur Messe PacPro '88" vom 05.–Nov. 5, 1988 in Dusseldorf, Seite 1 und Seite 12 (trade journal).

Papier & Kunststoff Verarbeiter, vol. 23, No. 9, Sep. 1988, Frankfurt DE. pp. 40 42 44 XP002006545 E. Schulz: Nahtlose Fotopolymer–Druckwalzen nach dem Hulsenprinzip.

Zeitschrift druck print Dec./1987 Seite 20 bis 22 (trade journal).

Zeitschrift EFM/Sep. 1987, Seite 22 bis 24 (trade journal).

Patent Abstracts of Japan, vol. 6, No. 201 (M–163), 13 Oct. 1982 & JP–A–57 107842 (Dainippon Printing Co. Ltd.).

Nouvelles Graphiques, vol. 38, No. 18, Oct. 1988, Deurne BE. pp. 20 24 25 XP002006546 A. Vermeire: Stork Revolutionne la Serigraphie avec ses manchons la trame Himesh.

Patent Abstracts of Japan, vol. 6, No. 201 (M–163), 13 Oct. 1982 & JP–A–57 107843 (Dainippon Printing Co. Ltd.).

*Primary Examiner*—John S. Hilten
*Assistant Examiner*—Daniel J. Colilla
*Attorney, Agent, or Firm*—Dority & Manning, P.A.

[57] ABSTRACT

A cylindrical spacer sleeve is interposed between a printing sleeve, which carries printing matrices, and a printing cylinder. The spacer sleeve has an innermost core member that is expandable by interposition of air pressure between the inner surface of the core member and the outer surface of the printing cylinder. In an alternative embodiment, the core member is not expandable. The outer surface of the spacer sleeve torsionally rigidly supports by an interference fit, the printing sleeve. A rigid bridge layer is disposed between the outer surface and the core member. The spacer sleeve has a plurality of air channels through which pressurized air is supplied from within the bridge layer to the outer surface. In one embodiment, the bridge layer includes a pair of axially spaced apart spacer rings. Pressurized air flowing through the channels assists in expanding the diameter of the innermost surface of the printing sleeve for alternatively mounting the printing sleeve onto the spacer sleeve and dismounting the printing sleeve from the spacer sleeve.

22 Claims, 14 Drawing Sheets

U.S. PATENT DOCUMENTS

| | | | |
|---|---|---|---|
| 3,146,709 | 9/1964 | Bass et al. . | |
| 3,475,803 | 11/1969 | Hill . | |
| 3,673,025 | 6/1972 | Fukuyama et al. . | |
| 3,959,574 | 5/1976 | Seanor et al. . | |
| 3,978,254 | 8/1976 | Hoexter et al. . | |
| 4,030,415 | 6/1977 | Fellows . | |
| 4,044,678 | 8/1977 | Rasmussen . | |
| 4,089,265 | 5/1978 | White et al. . | |
| 4,119,032 | 10/1978 | Hollis . | |
| 4,144,812 | 3/1979 | Julian . | |
| 4,144,813 | 3/1979 | Julian . | |
| 4,296,172 | 10/1981 | Hill . | |
| 4,381,709 | 5/1983 | Katz . | |
| 4,496,434 | 1/1985 | Morssinkhof . | |
| 4,503,769 | 3/1985 | Andersen . | |
| 4,554,040 | 11/1985 | van der Velden . | |
| 4,583,460 | 4/1986 | Maslin et al. . | |
| 4,624,184 | 11/1986 | Katz et al. | 101/375 |
| 4,641,411 | 2/1987 | Meulen . | |
| 4,651,643 | 3/1987 | Katz et al. | 101/375 |
| 4,794,858 | 1/1989 | Katz . | |
| 4,903,597 | 2/1990 | Hoage et al. . | |
| 4,934,266 | 6/1990 | Fantoni . | |
| 5,206,992 | 5/1993 | Carlson et al. . | |
| 5,316,798 | 5/1994 | Tittgemeyer . | |
| 5,468,568 | 11/1995 | Kuhn et al. . | |
| 5,544,584 | 8/1996 | Thompson et al. . | |
| 5,706,731 | 1/1998 | Francille et al. | 101/375 |
| 5,711,222 | 1/1998 | Taylor et al. | 101/383 |

AIR CARRIER SPACER SLEEVE FOR A PRINTING CYLINDER

The present application is a continuation-in-part application to application Ser. No. 08/613,895, which was filed on Mar. 11, 1996.

BACKGROUND OF THE INVENTION

The present invention relates to flexographic and gravure printing and more particularly to such printing involving printing sleeves that are air-mounted on printing cylinders.

The patents to Bass et al (U.S. Pat. No. 3,146,709), Hoexter et al (U.S. Pat. No. 3,978,254), Fellows (U.S. Pat. No. 4,030,415), Julian (U.S. Pat. No. 4,144,812), Bardin (U.S. Pat. No. 4,197,798), Hoage et al (U.S. Pat. No. 4,903,597) and Kuhn et al (U.S. Pat. No. 5,468,568), pertain primarily to printing sleeves, which carry the printing matrices used for applying ink to a substrate. The patents to White et al (U.S. Pat. No. 4,089,265) and Katz (U.S. Pat. No. 4,794,858) pertain primarily to the printing cylinders (a.k.a. mandrels) on which the printing sleeves are mounted when performing the printing function.

As known in the art, the diameter of the inner surface of the air-mounted printing sleeve must be slightly smaller than the diameter of the outer surface of the printing cylinder. The difference in these diameters is a dimension known as the interference fit. Moreover, the diameter of the inner surface of the printing sleeve must be expandable by the provision of pressurized air between the opposed surfaces of the sleeve and the printing cylinder in order to mount such printing sleeves onto the printing cylinders as well as remove the sleeves therefrom.

In addition, if the transverse cross-sectional shape of the outer surface of the printing cylinder is conical so as to taper slightly from one end of the cylinder to the opposite end, then the transverse cross-sectional shape of the inner surface of the printing sleeve also must be commensurately conical so as to taper from one end of the sleeve to the other end of the sleeve. In this way, the so-called tapered sleeve is fitted to mount securely to the so-called tapered printing cylinder. Similarly, if the transverse cross-sectional shape of the outer surface of the printing cylinder is parallel to the cylinder's axis of rotation from one end of the printing cylinder to the opposite end, then the transverse cross-sectional shape of the inner surface of the printing sleeve also must be parallel to the rotational axis from one end of the sleeve to the other end of the sleeve. In this way, the so-called parallel sleeve is fitted to mount securely to the so-called parallel printing cylinder.

A parallel printing sleeve cannot be mounted on a tapered printing cylinder. Similarly, a tapered printing sleeve cannot be mounted on a parallel printing cylinder.

Typically, a printing job will involve an "image repeat," which is the circumferential length of the text and graphics that are to be printed one or more times on the substrate with each revolution of the printing sleeve. The circumference of the printing sleeve must be large enough to contain at least one image repeat. The sleeve repeat, which is equivalent to the sleeve's circumference (including the printing plate mounted on the sleeve), can contain a number of image repeats. Different printing jobs involve image repeats that differ in size, and different printing jobs require sleeve repeats that differ in size. The larger sleeve repeat sizes require printing sleeves with larger circumferences, which means larger outer diameters. When a "converter," i.e., the operator of the machinery that uses a printing sleeve, orders a printing sleeve that is set up with the printing plates for a job that demands a given sleeve repeat size, the inner diameter of that printing sleeve is determined based on the outer diameter of the printing cylinders on hand in that converter's inventory. This is because the printing sleeve must be mounted on a printing cylinder that has a commensurate outer diameter.

To perform a job that requires a large sleeve repeat size, the diameter of the outer surface of the printing sleeve must be large enough to yield the large sleeve repeat size. This requires printing cylinders with larger outer diameters to support thin printing sleeves. However, new printing cylinders are expensive. As an alternative to incurring this expense, thicker printing sleeves resulting from multiple layers are used instead of the single layer, so-called "thin" sleeves. The patents to Thompson et al (U.S. Pat. No. 5,544,584) and Maslin et al (U.S. Pat. No. 4,583,460) describe multi-layer printing sleeves that can be mounted on relatively smaller diameter printing cylinders. The multi-layer printing sleeves have the effect of reducing the inner diameter of the sleeve so that the sleeve can be mounted on a smaller diameter printing cylinder that is already available in the converter's inventory. Multi-layer sleeves are less expensive than printing cylinders, but more expensive than thin sleeves.

Moreover, it is more costly in labor to change printing cylinders on the printing machinery than it is to change printing sleeves on a printing cylinder. However, this solution has lead to a proliferation of multi-layer printing sleeves, which are more costly than the thin sleeves. Moreover, it is more costly to mount and unmount multi-layer printing sleeves than thin sleeves.

Rather than rely on air-mounted sleeve systems, some printing machines still rely on printing cylinders with an outer surface that is circumferentially expandable through the use of an hydraulic system. One such system is disclosed in the patent to Wyllie et al (U.S. Pat. No. 3,166,013).

In such hydraulic-based, sleeve-mounting systems, larger repeat sizes can be printed using multi-layer printing sleeves. In one such multi-layer printing sleeve known as the CUSHION MYTHO sleeve, which is sold by the assignee of the present application, an innermost hollow core layer is formed of carbon fiber reinforced polymeric material. The carbon fiber reinforced polymeric core does not expand when subjected to the hydraulic force exerted by the expansion of the outer surface of the printing cylinder. The outermost surface of the carbon fiber reinforced polymeric layer, which outermost surface is ridged and thus uneven, is covered with a rigid layer formed of hardened polyurethane foam. The outermost surface of the rigid polyurethane layer is ground and finished to become cylindrical and concentric with the cylindrical interior surface of the carbon fiber reinforced polymeric layer. This layer of hardened polyurethane foam is used to increase the thickness of the overall printing sleeve in order to provide the desired repeat size. The outer surface of the rigid foam layer is covered with a fiberglass reinforced polymeric layer. The outer surface of the fiberglass reinforced polymeric layer is ridged and thus uneven and is covered with a layer of compressible material. The outer surface of the compressible material layer is ground and finished to become smooth and cylindrical and concentric with the cylindrical interior surface of the carbon fiber reinforced polymeric layer. The outer surface of the compressible layer, which is the so-called "cushion" layer, is used to support the printing plates or matrices that are mounted thereon.

In other such hydraulic-based, sleeve-mounting systems, larger repeat sizes can be printed using a thin sleeve mounted on an intermediate sleeve that can be provided with pressurized air to mount and unmount the thin sleeve. In one such intermediate sleeve system known as the MYTHO SYSTEM™, which is sold by the assignee of the present application, an innermost hollow core layer is formed of carbon fiber reinforced polymeric material. The carbon fiber reinforced polymeric core does not expand when subjected to the hydraulic force exerted by the expansion of the outer surface of the printing cylinder. The outermost surface of the carbon fiber reinforced polymeric layer, which outermost surface is ridged and thus uneven, is covered with a rigid layer formed of hardened polyurethane foam. The outermost surface of the rigid polyurethane layer is ground and finished to become cylindrical and concentric with the cylindrical interior surface of the carbon fiber reinforced polymeric layer. This layer of hardened polyurethane foam is used to increase the thickness of the overall printing sleeve in order to provide the desired repeat size. About an inch from the leading end of the sleeve, a circumferential groove is machined into the layer of hardened polyurethane foam, and the deeper portion of this groove is shielded with a circumferential ring. The outer surface of the rigid foam layer and the circumferential ring are covered with an incompressible, carbon fiber reinforced polymeric layer. The outer surface of the incompressible, carbon fiber reinforced polymeric layer is ground and finished to become smooth and cylindrical and concentric with the cylindrical interior surface of the carbon fiber reinforced polymeric layer. This outer surface will substitute for the rigid metallic surface of the printing cylinder, which is used to support the thin sleeves to which the printing plates or matrices are mounted. A series of radially extending holes are drilled through the outer layer of carbon fiber reinforced polymeric material and through the circumferential ring so as to communicate with the deeper portion of the groove formed in the rigid foam layer. An axially extending hole is drilled through the leading end of the sleeve and communicates with the deeper portion of the groove formed in the rigid foam layer. The axial hole is provided with a fixture for connecting to a supply of pressurized air that can be used to mount the thin sleeves to which the printing plates or matrices are mounted.

OBJECTS AND SUMMARY OF THE INVENTION

It is a principal object of the present invention to provide an apparatus that would lower the cost of accommodating multiple jobs of a certain sleeve repeat size while limiting the number of expensive printing cylinders or multiple sets of expensive multi-layer sleeves that a converter must keep in inventory.

It is another principal object of the present invention to provide an apparatus that enables a converter to use any printing cylinder with any thin printing sleeve or multi-layer printing sleeve.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the present invention pertains to an intermediate sleeve, a spacer sleeve or bridge sleeve if you will, that is interposed between the printing cylinder and an inexpensive printing sleeve. The spacer sleeve includes a core member that has an inner surface configured to be mounted on the outer surface of a printing cylinder. A bridge layer is interposed between the core member and an outer cylindrical layer, which has an outer surface that is configured to receive a printing sleeve mounted thereon. During manufacture, the diametric thickness of the bridge layer is chosen to accommodate the desired repeat sizes of the printing sleeves to be mounted on the spacer sleeve. The spacer sleeve has a means for providing pressurized air to the outer surface of the outer cylindrical layer in order to facilitate the mounting of printing sleeves on the outer surface in a conventional manner. In a presently preferred embodiment, the pressurized air providing means includes an air supply channel that is embedded in the bridge layer. In a presently preferred embodiment, the inner surface of the core member is diametrically expandable in a resilient fashion, and the outer surface of the core member is disposed against a compressible means that accommodates the diametric expansion and contraction of the core member.

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

The present invention is especially desired by printers who operate flexographic or gravure printing machines and have several print jobs that require the same sleeve repeat size. To reduce the number of differently diametered printing cylinders and multi-layer printing sleeves that must be maintained in a printer's inventory, it is desirable to be able to use an inexpensive printing sleeve for any sleeve repeat size larger than the smallest diameter printing cylinder that is available in a printer's inventory. This is accomplished in accordance with the present invention by providing a spacer sleeve that makes up the difference between the outer diameter of the printing cylinder and the larger innermost diameter of a thin printing sleeve. The spacer sleeve of the present invention is configured so that it can be air-mounted on a printing cylinder. Moreover, the spacer sleeve of the present invention is further configured so that inexpensive thin printing sleeves can be air-mounted onto the spacer sleeve. It is less expensive for the printer to use the spacer sleeve of the present invention to mount thin sleeves than either to buy new printing cylinders with diameters large enough to mount the thin sleeves or to buy several sets of multi-layer sleeves, each set with a different set of printing plates for each different printing job.

As known, printing cylinders can be provided with a register pin in order to facilitate repeatable orientation of the printing sleeve thereon via a keyway or slot formed in the sleeve. For printing cylinders so fitted, the spacer sleeve of the present invention can be provided with a similar keyway or slot for adapting to such printing cylinders and/or a similar pin for adapting such printing sleeves. However, as this sort of adaptation is well known, it will not be discussed further nor specifically shown in the accompanying drawings of the various embodiments.

Figure 9:
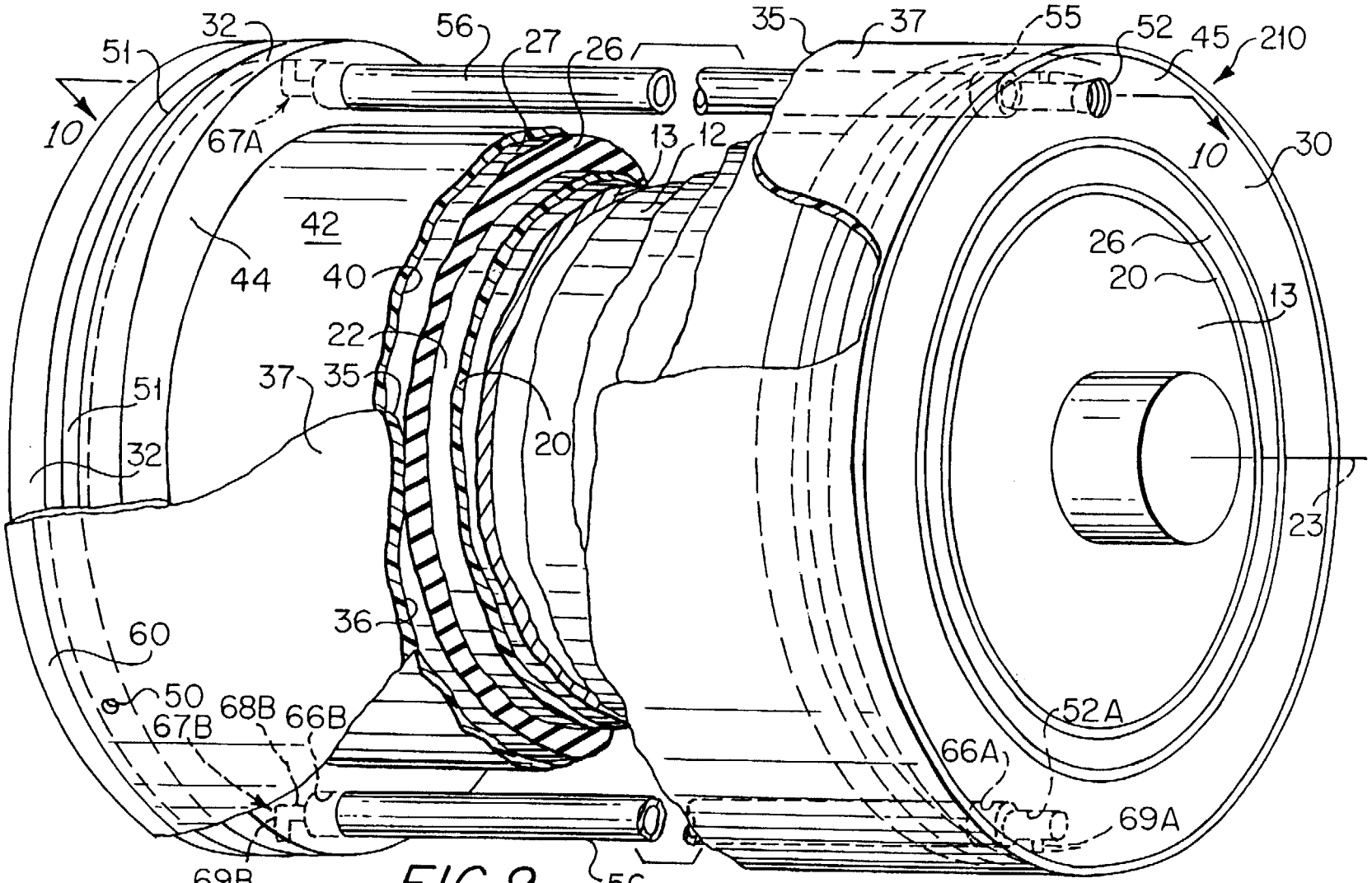
FIG. 9 is an elevated perspective view with portions partially broken away, of a presently preferred embodiment of the invention mounted on a printing cylinder.
Figure 10:
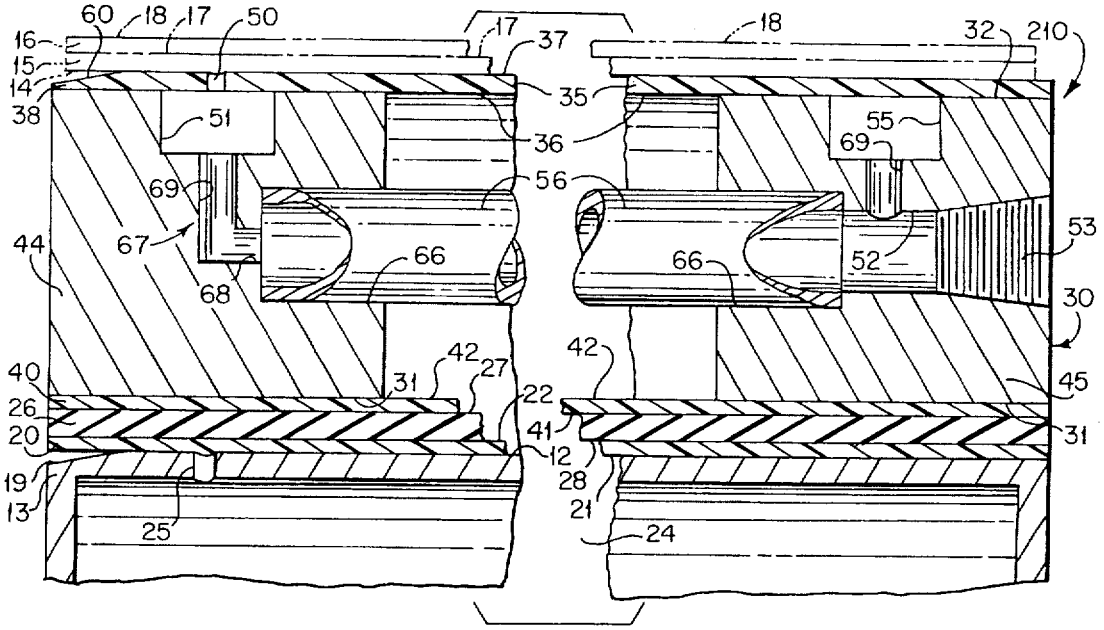
FIG. 10 is a partial cross-sectional view taken along the line of sight designated by the numerals 10—10 in FIG. 9.

A presently preferred embodiment of a spacer sleeve that is configured in accordance with the present invention, is shown in FIGS. 9 and 10 and is represented generally by the numeral 210. As shown in FIG. 10, spacer sleeve 210 functions as a bridge sleeve and as such is disposed between the outermost surface 12 of the printing cylinder 13 and the innermost surface 14 (FIG. 10), i.e., mounting surface, of a printing sleeve 15. As shown in FIG. 10, printing sleeve 15 is a so-called thin sleeve, but could just as easily be a multi-layer sleeve. As is typical, a printing plate 16 is attached to the outer surface 17 of printing sleeve 15 and has an outer surface 18 that defines the image to be printed on the substrate (not shown) forming the media that is to be printed. FIGS. 2–4, 7B and 10 depict printing plate 16 and thin printing sleeve 15 in phantom by the use of chain-dashed lines.

Figure 1:
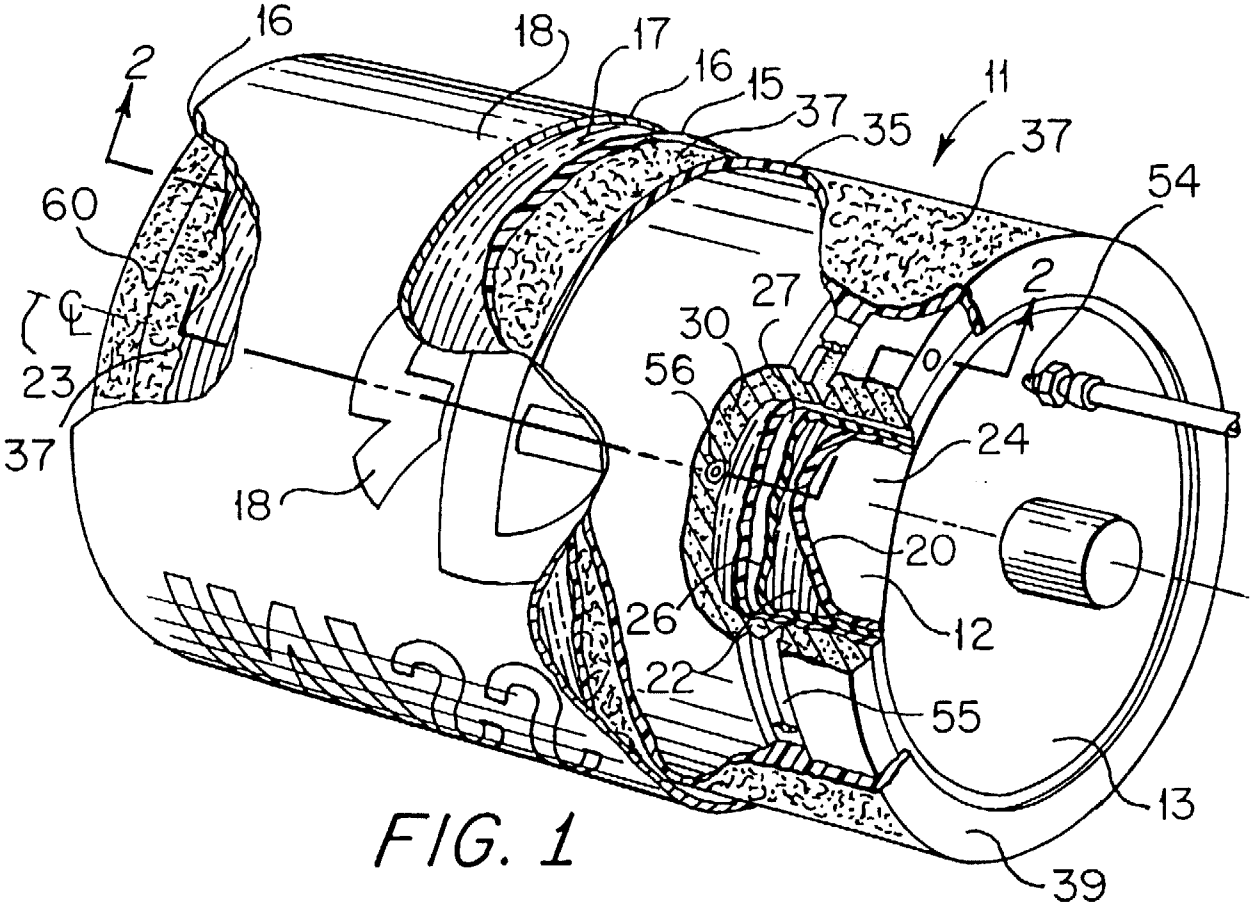
FIG. 1 is an elevated perspective view with portions partially broken away, of an alternative embodiment of the present invention mounted on a printing cylinder.
Figure 2:
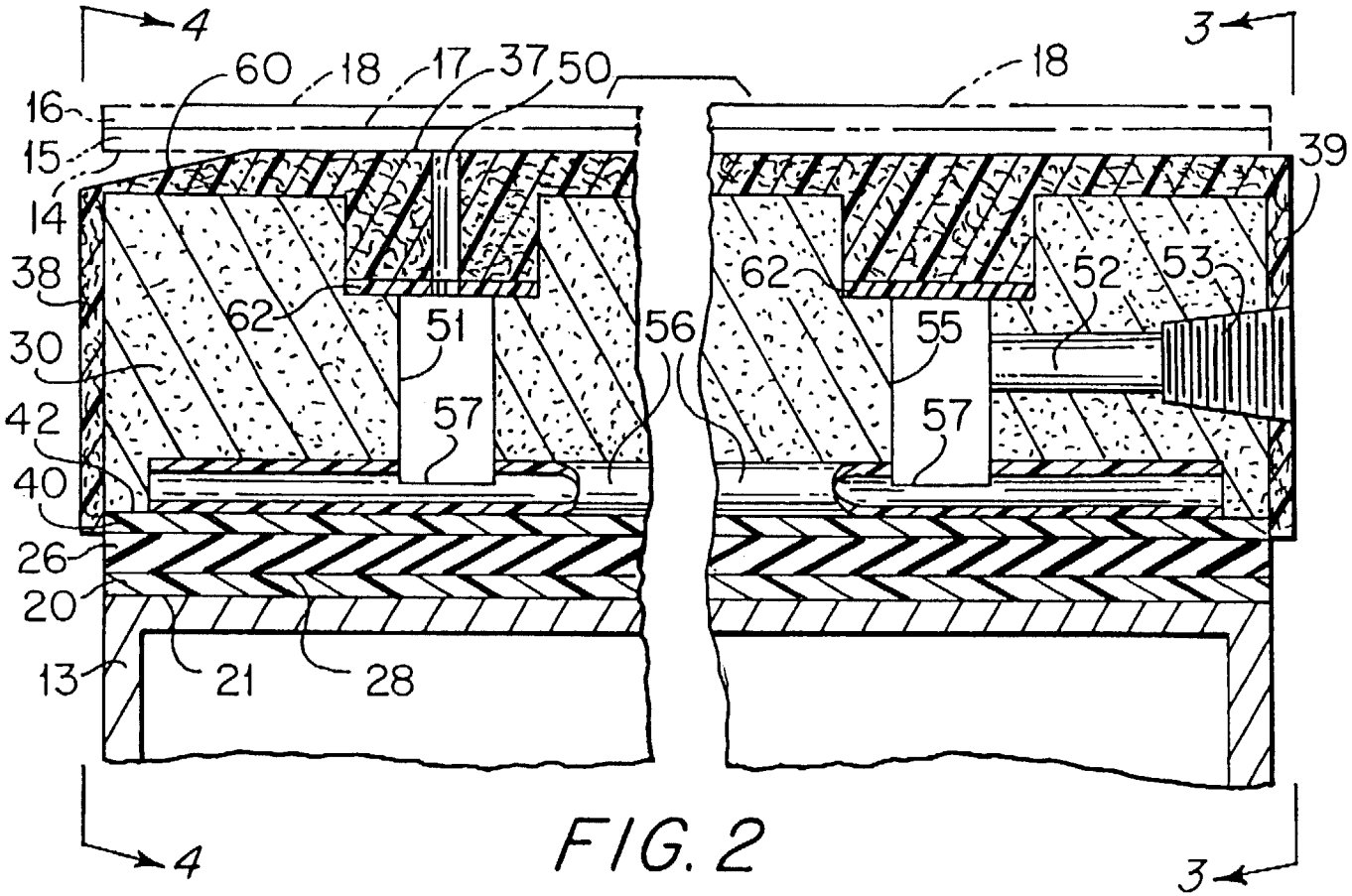
FIG. 2 is a partial cross-sectional view taken along the line of sight designated by the numerals 2—2 in FIG. 1.
Figure 11:
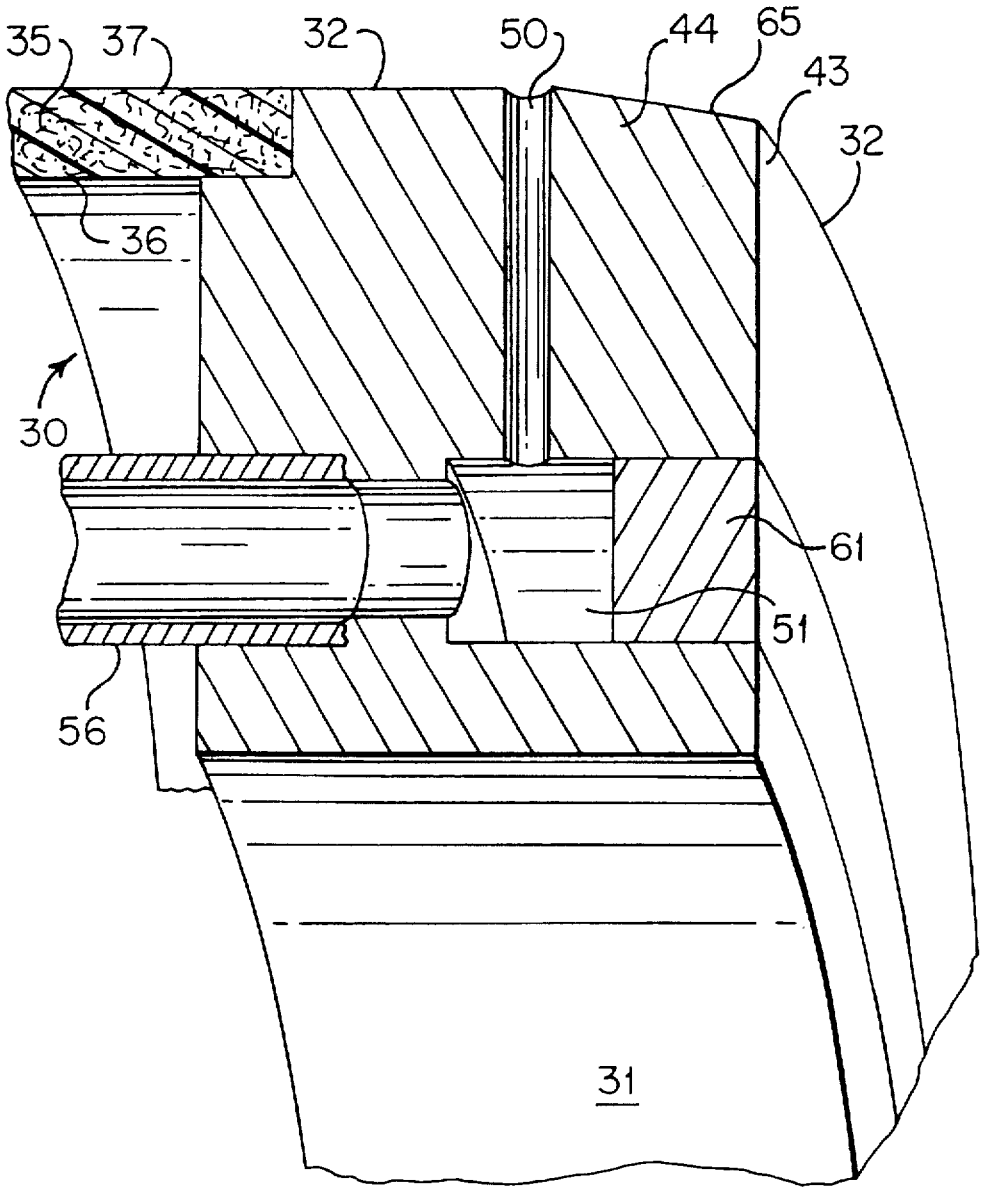
FIG. 11 is a partial elevated perspective view of portions of an alternative embodiment of components of the invention taken partially in axial cross-section.
Figure 12:
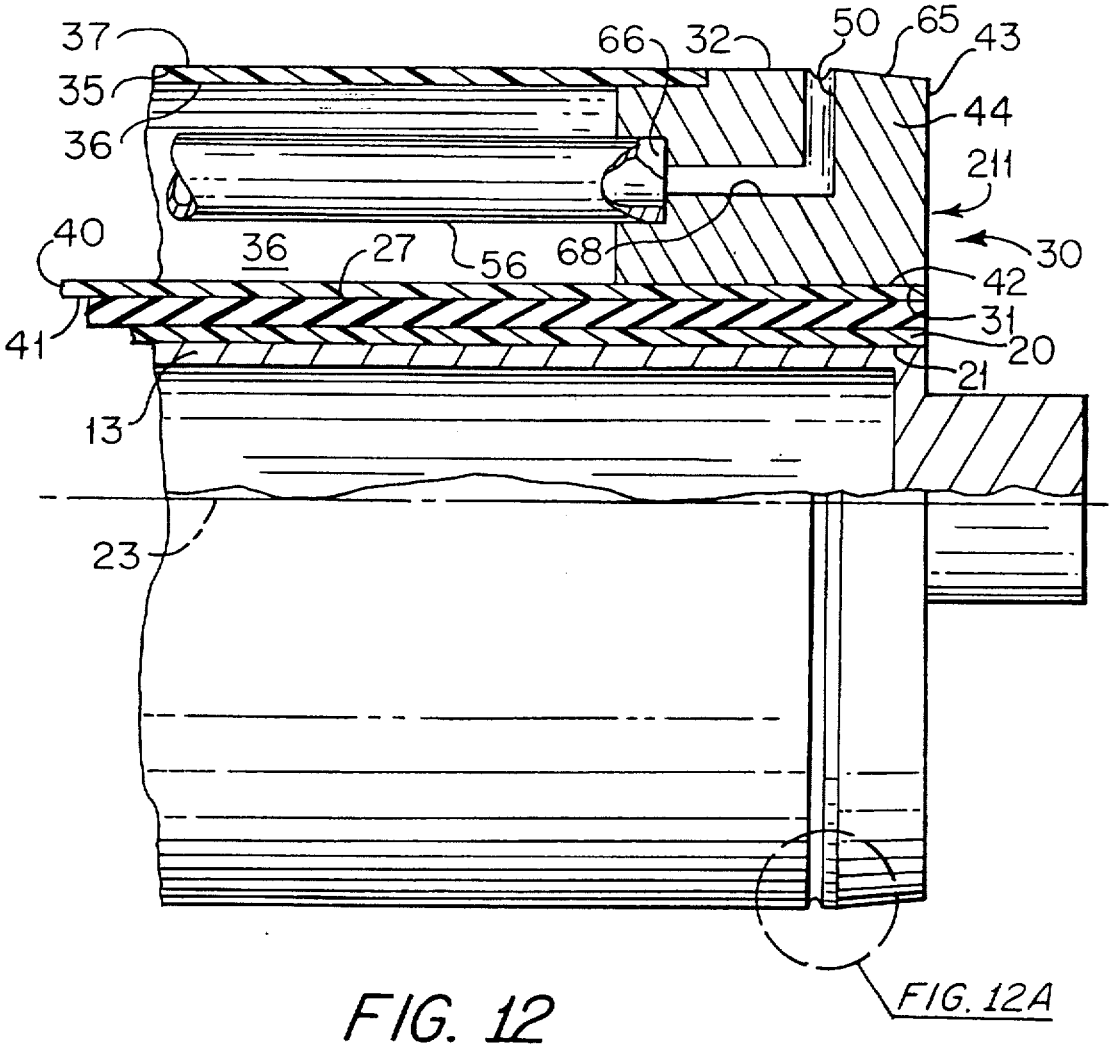
FIG. 12 is a partial side plan view of portions of still another alternative embodiment taken partially in axial cross-section.
Figure 12A:
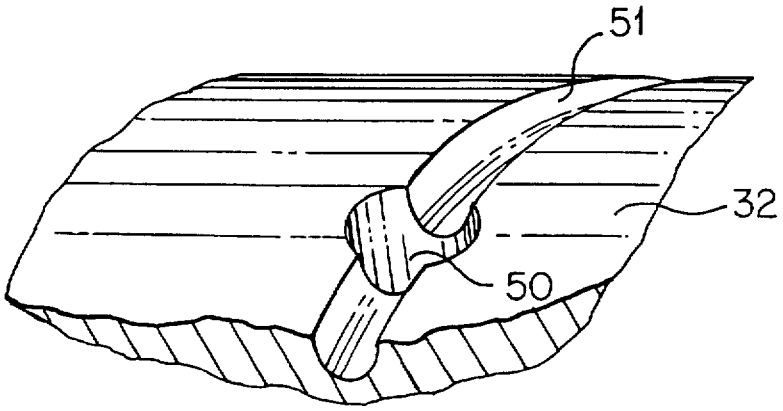
FIG. 12A is an enlarged, partial, elevated perspective view of the portion of the alternative embodiment taken partially in axial cross-section from the circled portion shown in FIG. 12.
Figure 13A:
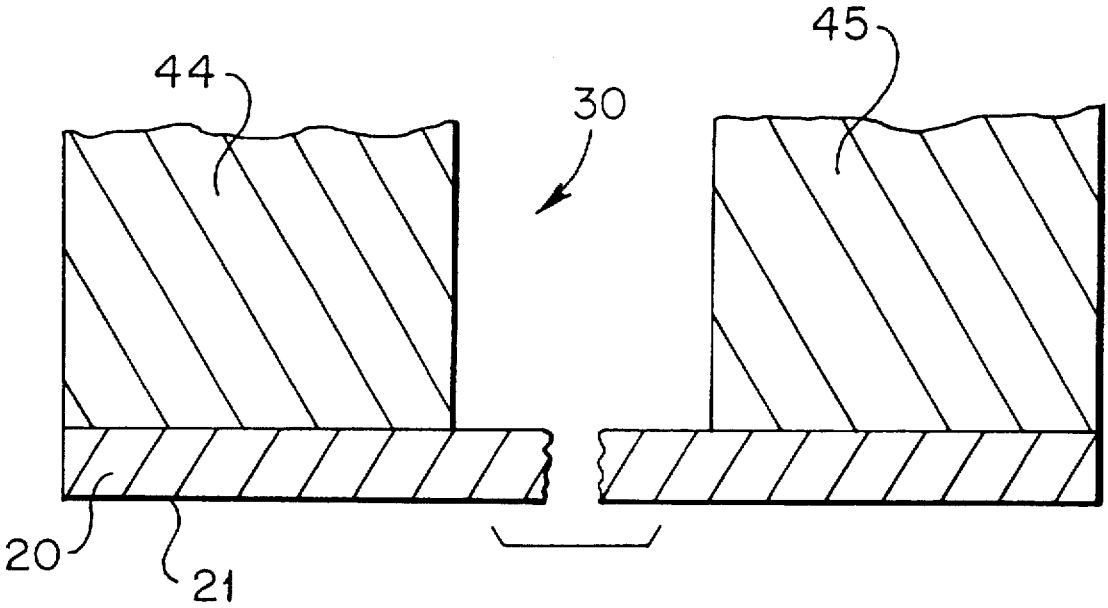
FIG. 13A is a partial axial cross-sectional view of a further alternative embodiment of components of the present invention.
Figure 13B:
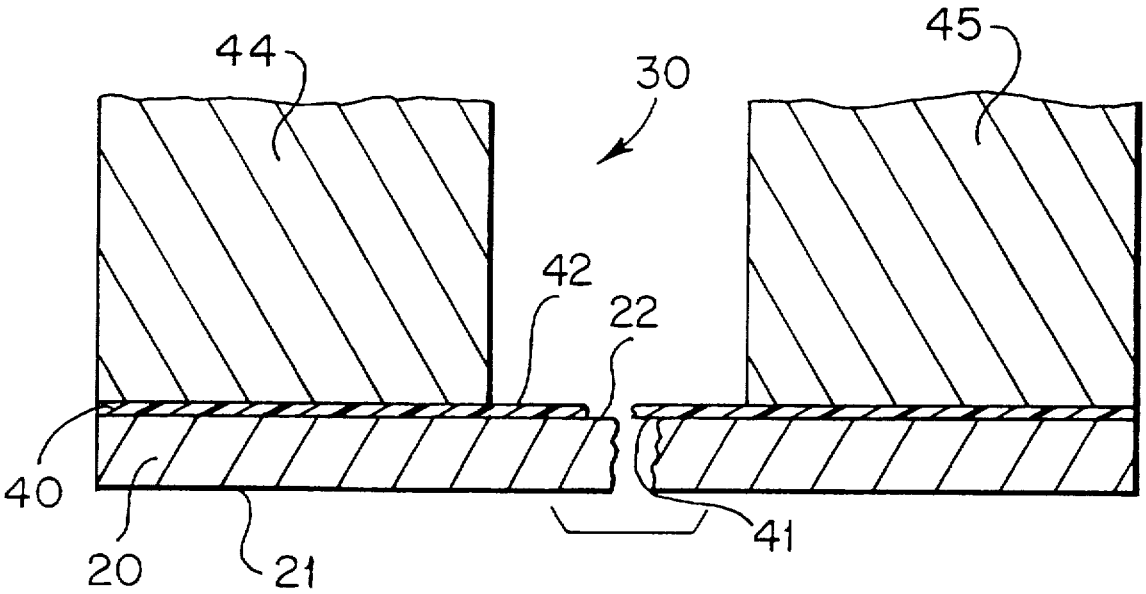
FIG. 13B is a partial axial cross-sectional view of a yet another alternative embodiment of components of the present invention.

Illustrative portions of an alternative embodiment of a spacer sleeve that is configured in accordance with the present invention, are shown in FIGS. 12 and 12A, and this alternative embodiment is represented generally in FIG. 12 by the numeral 211. FIG. 11 depicts portions of components of another alternative embodiment of a spacer sleeve of the present invention. FIGS. 13A and 13B illustrate portions of components of still other alternative embodiments of the present invention. Yet another alternative embodiment of a spacer sleeve of the present invention, is shown in FIGS. 1 and 2 and is represented generally by the numeral 11. Still another alternative embodiment of a spacer sleeve of the present invention is shown in FIGS. 5–7A and is represented generally by the numeral 111.

Figure 3:
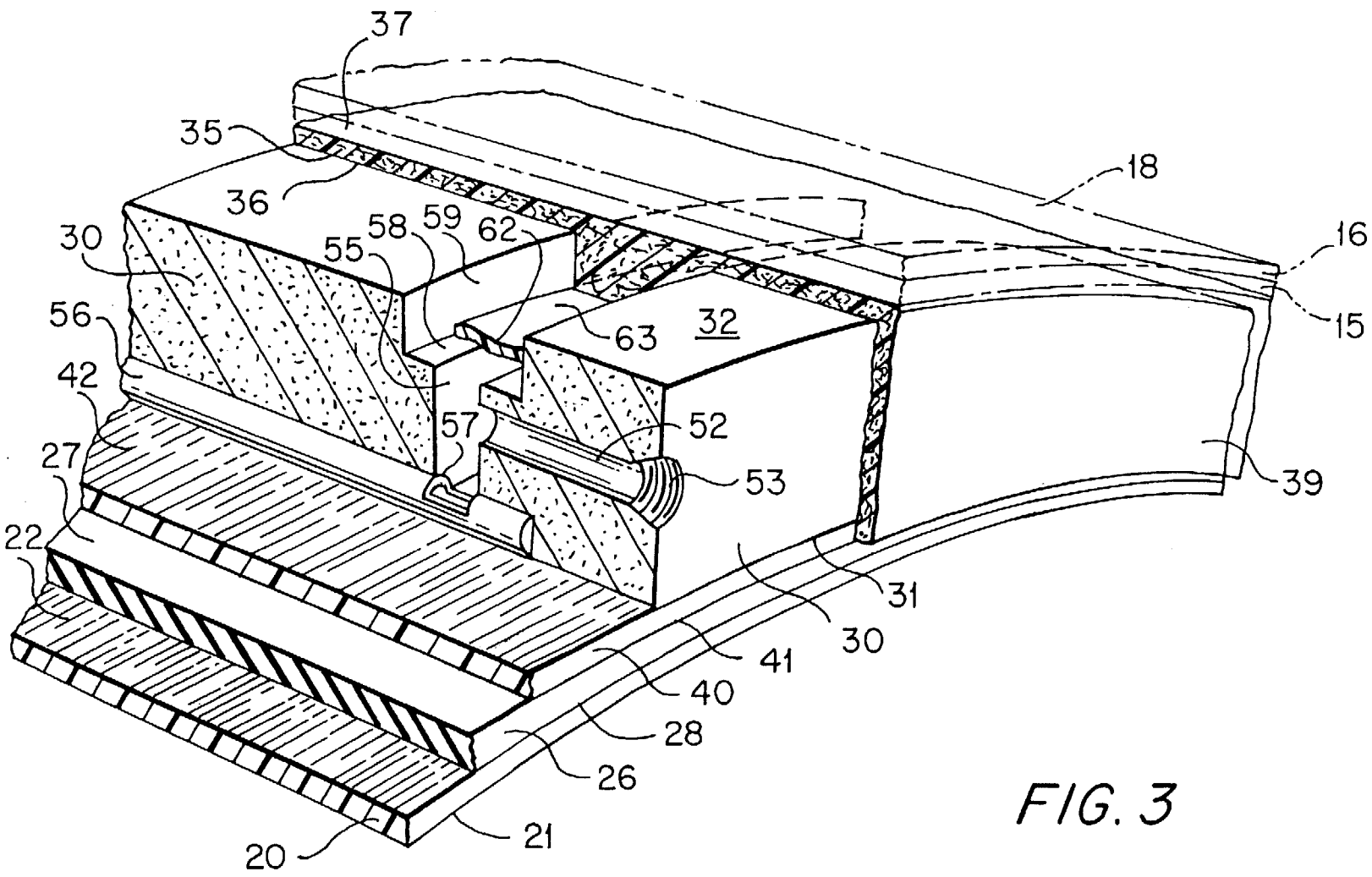
FIG. 3 is a partial elevated perspective view taken along the line of sight designated by the numerals 3—3 in FIG. 2.
Figure 4:
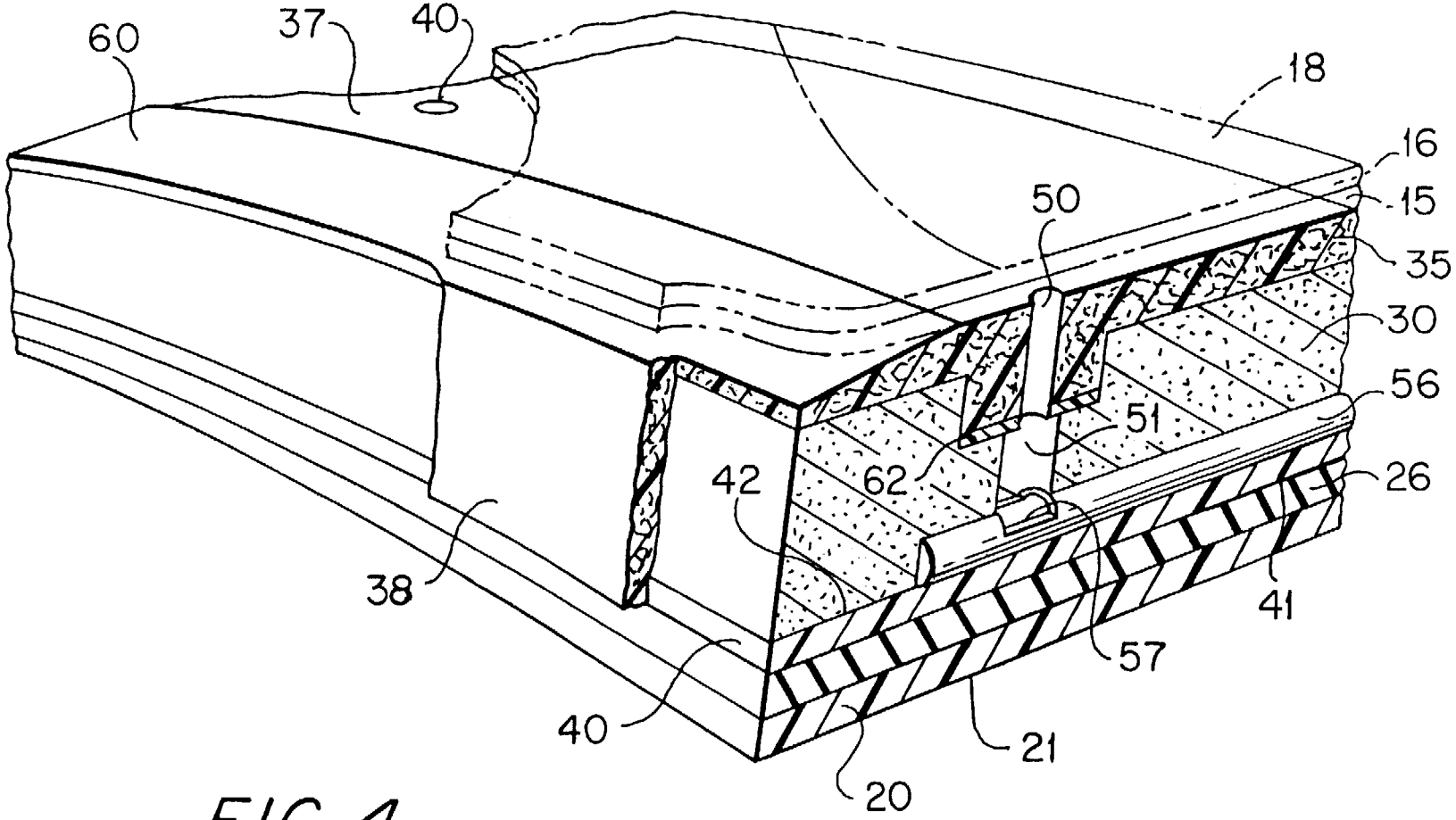
FIG. 4 is a partial elevated perspective view taken along the line of sight designated by the numerals 4—4 in FIG. 2.

In accordance with the present invention, the spacer sleeve includes a core member having a generally cylindrical shape. As embodied herein and shown in FIGS. 1, 2, 7A, 7B, 9, 10, 12, 13A and 13B for example, a core member 20 constitutes the innermost portion of the spacer sleeve. As shown in FIGS. 1, 7A, 10, 12, 13A and 13B for example, core member 20 has a cylindrical inner surface 21, which is also shown schematically in FIGS. 8A, 8B, 8C and 8D. As shown in FIGS. 3 and 9 for example, core member 20 defines a cylindrical outer surface 22 that is generally concentric with inner surface 21.

As shown in FIGS. 1, 7A, 8A, 8B, 8C, 8D and 10 for example, cylindrical inner surface 21 of core member 20 is the wall surface that defines a hollow internal region 24 of the spacer sleeve. A central rotational axis 23 (FIGS. 1, 9 and 12) of the spacer sleeve and the core member 20, is disposed inside hollow region 24. The rotational axis 23 provides a convenient point of reference for describing various aspects of the spacer sleeve. For example, inner surface 21 of core member 20 is disposed relatively closer to the rotational axis 23 than is the outer surface 22 of core member 20. Moreover, each point along the axial length (which runs parallel to axis 23) of inner surface 21 is characterized by a diameter that is measured in a direction that is transverse, i.e., perpendicular or normal, to rotational axis 23.

In the preferred embodiments of the spacer sleeve, the core member is formed of a diametrically expandable, high rigidity material. Such material is diametrically expandable in an elastic manner so that core member 20 can be repeatedly expanded and contracted without adverse consequences in order to form an interference fit with the outer surface of a printing cylinder. The degree of permitted expansion and contraction need not be so large as to be detectable by the naked eye. Examples of compositions that are suitable for composing the core member include one of the group consisting of aramid fiber bonded with epoxy resin or polyester resin, and reinforced polymeric material such as hardened glass fiber bonded with epoxy resin or polyester resin, the latter two also known as fiberglass reinforced epoxy resin or fiberglass reinforced polyester. Aramid fiber is sold by Dupont under the KEVLAR® trademark. In these expandable embodiments, the core member can be made in a manner similar to the printing sleeves in the patent to Julian (U.S. Pat. No. 4,144,812), which is hereby incorporated herein by this reference. The radial thickness of core member 20 is desirably in the range of one (1) to seven (7) millimeters, with the larger thicknesses in this range being used as the sleeve increases in diameter and/or axial length. The thicker core members 20 prevent the larger diameter and/or longer, spacer sleeves from deflecting.

However, the embodiments shown in FIGS. 13A and 13B are intended to be mounted on the printing cylinder 13 via a line-to-line fit rather than an interference fit. Thus, in the embodiments shown in FIGS. 13A and 13B, additional materials, which do not expand, can be used to form core member 20. Such additional materials would include polyurethane with a hardness of more than 75 shore A or graphite impregnated plastics or carbon fiber composites. In the latter, the carbon fiber is desirably oriented parallel to the rotational axis 23 in order to provide core member 20 with maximum rigidity.

As shown in FIGS. 1, 2, 7A, 7B, 10, 12, 13A and 13B for example, inner surface 21 of core member 20 is intended to form the mounting surface for the spacer sleeve. Thus, inner surface 21 becomes torsionally rigidly attached to outer surface 12 of the printing cylinder 13 when the spacer sleeve 210, 11, 111, 211 is in use.

Figure 7A:
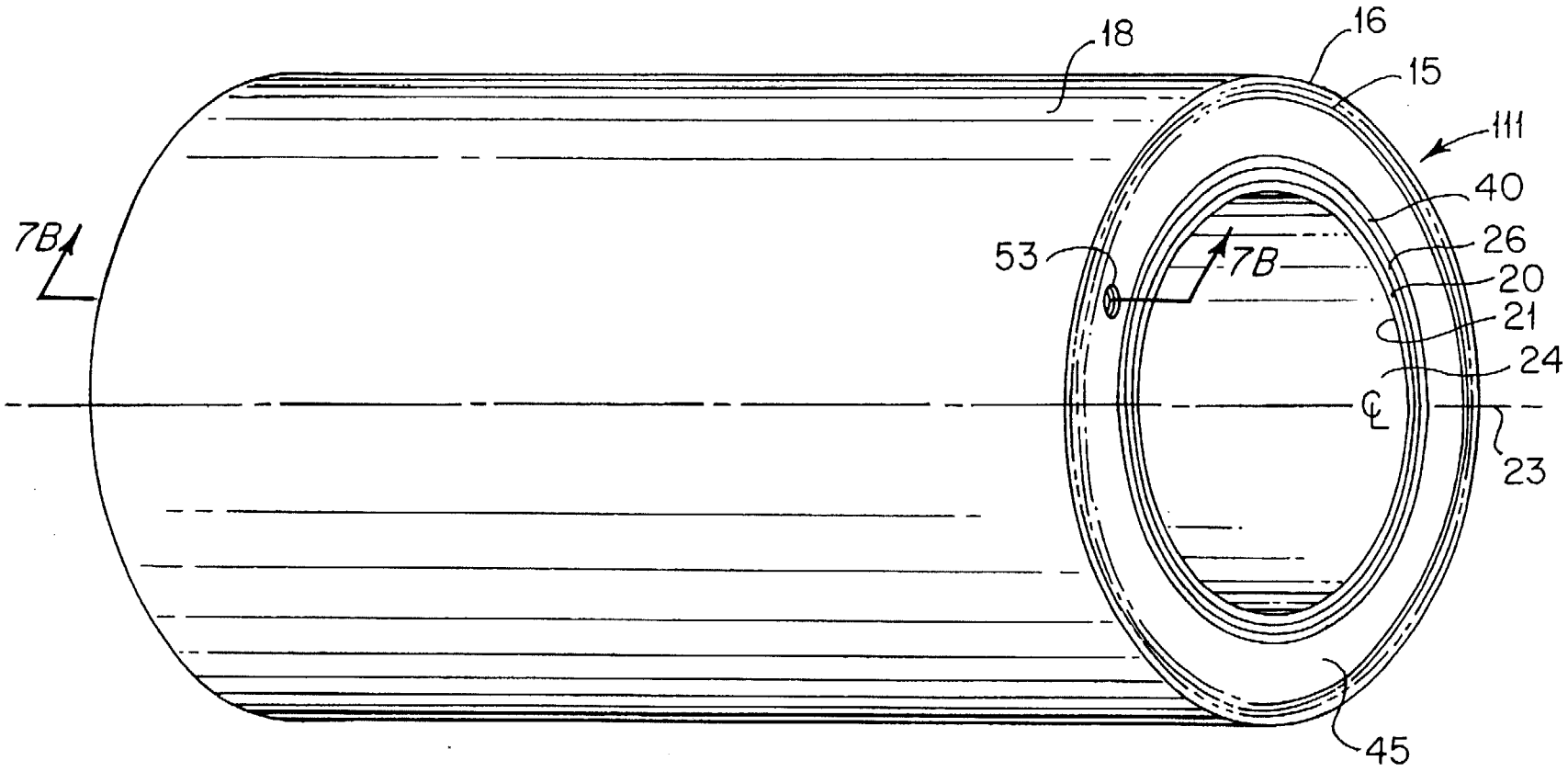
FIG. 7A is a front plan view of an embodiment as shown in FIGS. 5 and 6.
Figure 7B:
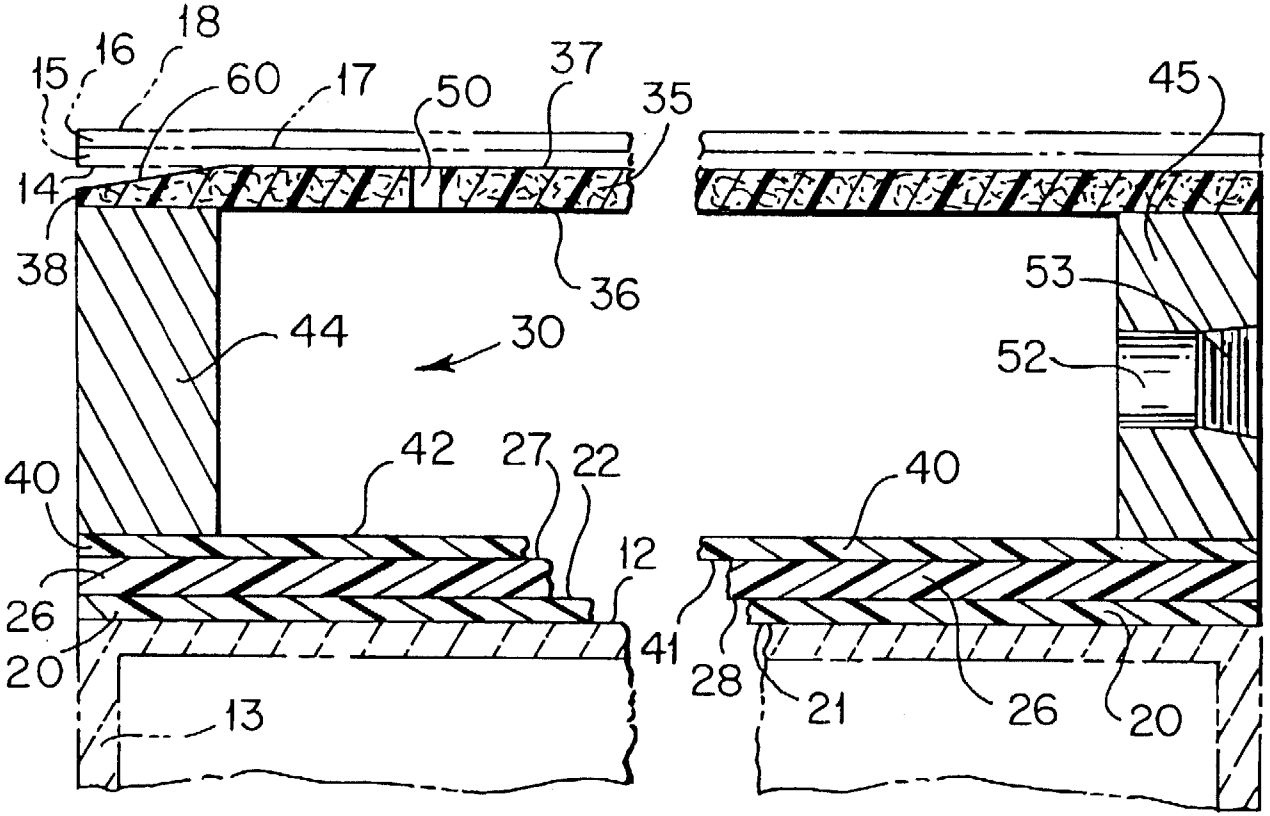
FIG. 7B is a partial cross-sectional view taken along the line of sight designated 7B—7B in FIG. 7A.

In accordance with the preferred embodiment of the present invention, the spacer sleeve includes a compressible means for mechanically absorbing radial expansion and contraction of the core member to accommodate the interference fit of the spacer sleeve. The compressible means has an inner surface that is disposed against the cylindrical outer surface of the core member. The compressible means has an outer surface that is disposed to face away from the core member. As embodied herein and shown in FIGS. 2, 7B and 9 for example, the compressible means can include a generally cylindrically-shaped rubber layer 26 that has elastic properties sufficient to deform enough to take up the radial expansion of core member 20 needed to mount on the printing cylinder. As shown in FIGS. 3, 7B and 10 for example, rubber layer 26 is defined by an outer surface 27 concentrically disposed with respect to an inner surface 28. As shown in FIGS. 3, 7B and 9 for example, outer surface 27 of rubber layer 26 is finished smooth. Though the drawing Figs. are not drawn to scale and certain relative thicknesses have been exaggerated in order to improve their visibility, rubber layer 26 typically has a radial thickness that is up to ¼" thick for a spacer sleeve with an interference fit in a range of about 0.004 to 0.010 inches.

In accordance with the present invention, the spacer sleeve includes a bridge layer formed of incompressible material and having a generally cylindrical shape. As shown in FIGS. 3, 4, 7B, 9, 101 11 and 12A for example, a bridge layer 30 has a radial thickness that constitutes the majority of the thickness of the spacer sleeve in all but those spacer sleeves having relatively smaller overall diameters. The diametrical thickness of bridge layer 30 is the portion of the spacer sleeve that is varied during manufacture of the spacer sleeve in order to accommodate the majority of the difference in diameter between the inner surface 14 of the printing sleeve 15 and the outer surface 12 of the printing cylinder 13.

As shown in FIGS. 5–7B and 9–13B, the presently preferred embodiment of the bridge layer 30 includes a pair of solid spacer rings 44, 45. First spacer ring 44 is disposed at the first end of the spacer sleeve. Second spacer ring 45 is disposed at the second end of the spacer sleeve. Spacer rings 44, 45 are composed of material such as aluminum that is incompressible, hard, lightweight and able to be configured to fine tolerances. Most of the volume occupied by the preferred embodiments of the bridge layer, which is generally designated by the numeral 30 in FIGS. 7B and 9–12, is empty space. In the alternative embodiment shown in FIGS. 1–4, most of the volume occupied by bridge layer 30 is formed of incompressible material such as rigid, expanded polyurethane foam, which FIGS. 1–4 show in cross-section with stippling to indicate that there are open cells therein.

Figure 5:
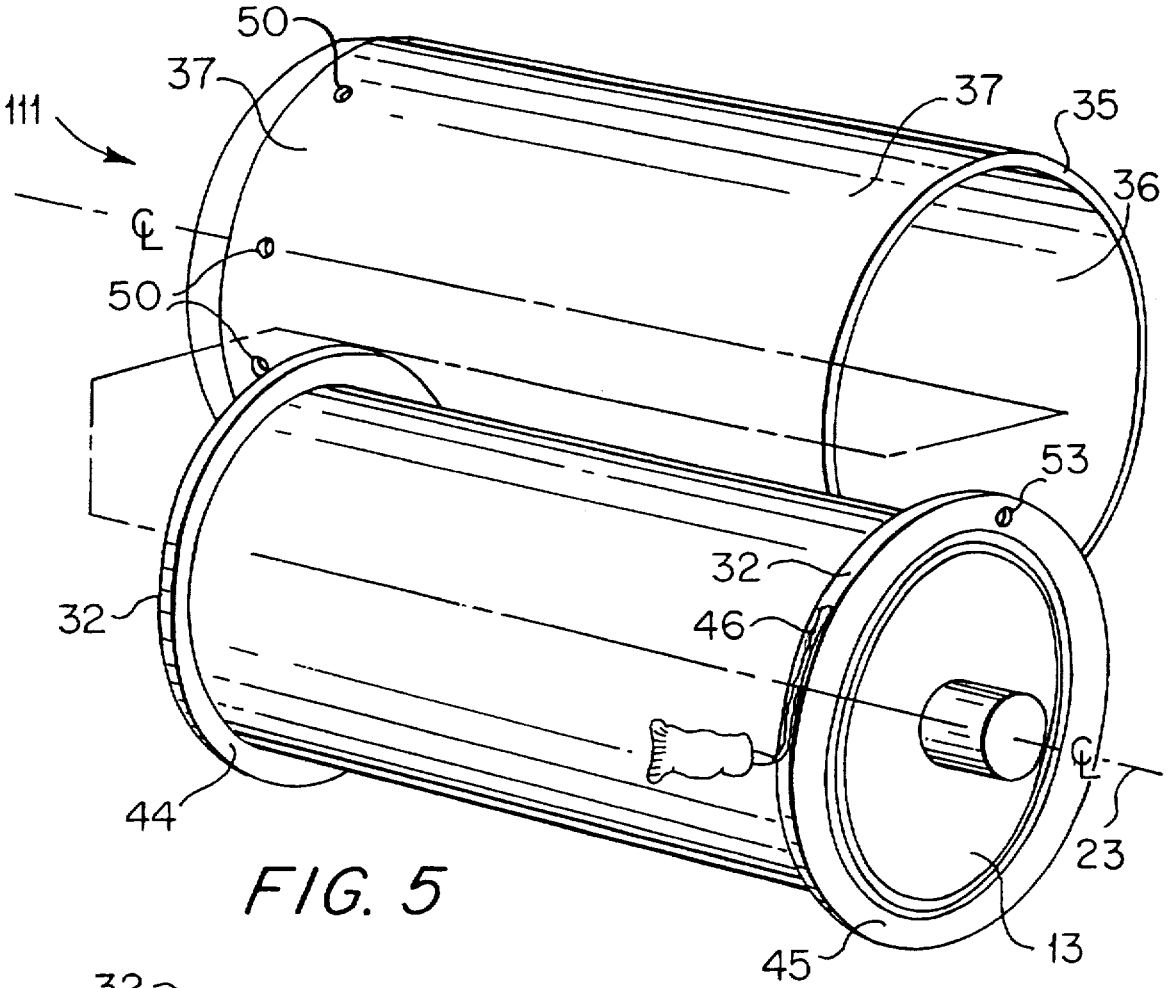
FIG. 5 is an elevated assembly perspective view of another alternative embodiment of the present invention mounted on a printing cylinder.
Figure 6:
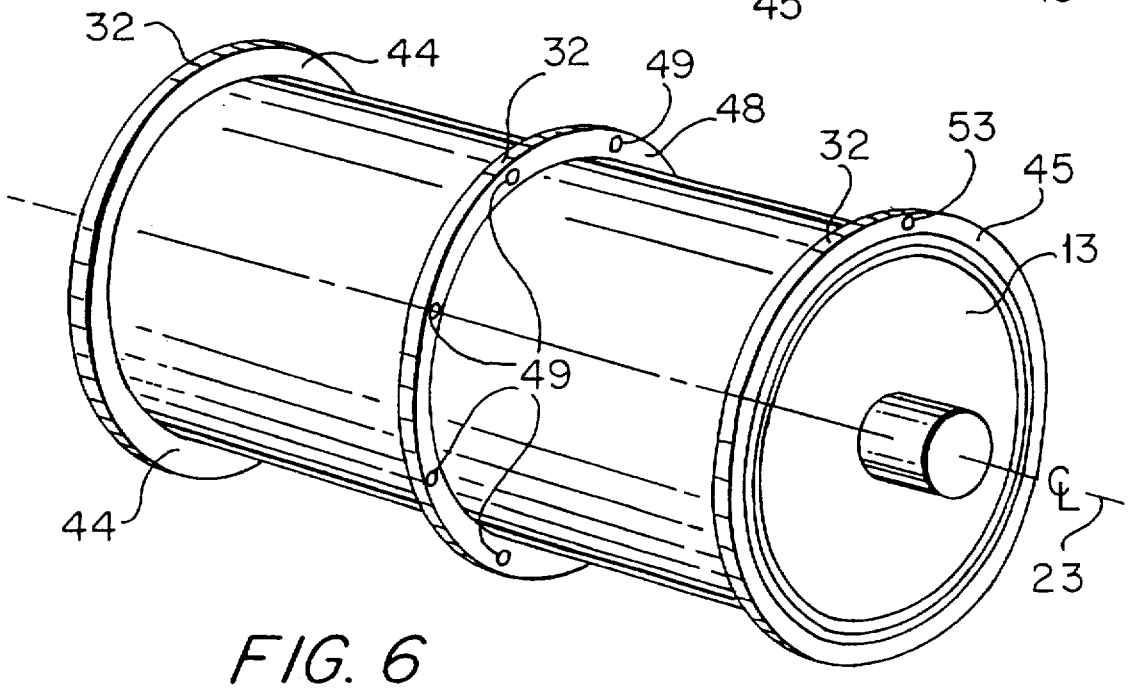
FIG. 6 is an elevated perspective view of components of yet another alternative embodiment of the present invention mounted on a printing cylinder.

In the alternative embodiments of the spacer sleeve shown in FIGS. 5, 6, and 7B for example, the bridge layer is also formed by a hollow compartment that is defined at opposed ends by spacer rings 44, 45. As shown in FIG. 7B for example, each spacer ring is further disposed radially between an inner surface 36 of an outer cylindrical layer 35 (described below) and an outer surface 42 of a transition layer 40 (described below). Moreover, as shown in FIG. 6 for example, one or more intermediate spacer rings 48 can be used to provide additional structural integrity, when the length of the spacer sleeve warrants.

As shown in FIGS. 3, 10, 11, 12, 13A and 13B for example, bridge layer 30 has an inner surface 31 that is disposed to face toward rotational axis 23 of the sleeve. Moreover, as shown in FIGS. 3 and 10, inner surface 31 of bridge layer 30 faces toward outer surface 27 of the compressible means that is formed by rubber layer 26. As shown in FIGS. 3, 10, 11, 12, 13A and 13B for example, bridge layer 30 has an outer surface 32 that is disposed to face away from rotational axis 23 of the sleeve. Moreover, as shown in FIGS. 3 and 10, outer surface 32 is disposed to face away from the compressible means.

In accordance with the present invention, the spacer sleeve includes an outer cylindrical layer. As shown in FIGS. 3, 5, 7B, 9, 10, 11, and 12 for example, an outer cylindrical layer 35 defines an inner surface 36 and an outer surface 37. In the embodiments shown in FIGS. 3, 5, 7B, 9 and 10, inner surface 36 of outer cylindrical layer 35 is disposed against outer surface 32 of bridge layer 30. Outer surface 37 of outer cylindrical layer 35 is provided with a smooth finish to a tolerance capable of supporting a printing sleeve thereon. The outer surface 37 is sufficiently smooth such that the combined Total Indicator Runout (TIR) of the spacer sleeve and a thin sleeve mounted thereon with printing plates, is less than 0.0015 inches.

In the embodiments shown in FIGS. 11 and 12, outer surface 37 of outer cylindrical layer 35 is disposed in alignment with and co-extensive to, outer surface 32 of bridge layer 30. In the embodiments of FIGS. 11 and 12, each opposite peripheral portion of outer layer 35 is received in a groove formed in the upper edge portion of an inner side of one of spacer rings 44, 45 in a tongue-in-groove fit.

Outer cylindrical layer 35 need not be expandable diametrically and preferably is rigid, non-elastic and minimizes any possible friction against the inner surface of the printing sleeve intended to be mounted thereon. Examples of materials that are suitable for composing the outer cylindrical layer 35 include aluminum, steel, aramid fiber bonded with epoxy resin or polyester resin, and carbon fiber-reinforced polymeric material such as carbon fiber bonded with epoxy resin or polyester resin, the latter two also known as carbon fiber reinforced epoxy resin or carbon fiber reinforced polyester resin.

In a fashion similar to inner surface 21 of core member 20, outer surface 37 of outer cylindrical layer 35 is characterized by a diameter at each point along the length thereof in a direction transverse to rotational axis 23. These two surfaces of the spacer sleeve are the key to configuring different embodiments of the spacer sleeve in order to accommodate the different types of printing sleeves (parallel and tapered) and the different types of printing cylinders (parallel and tapered).

Figure 8A:
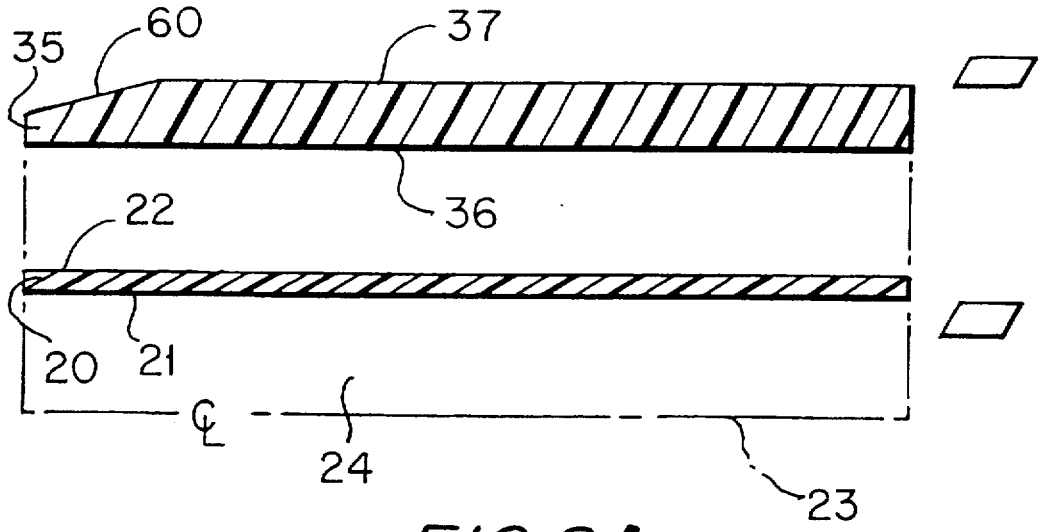
FIG. 8A schematically represents the relative orientations in a first embodiment of the present invention, of the exterior and interior surfaces relative to the rotational axis, which is indicated by the overlapping letters CL and the chain-dashed line.
Figure 8B:
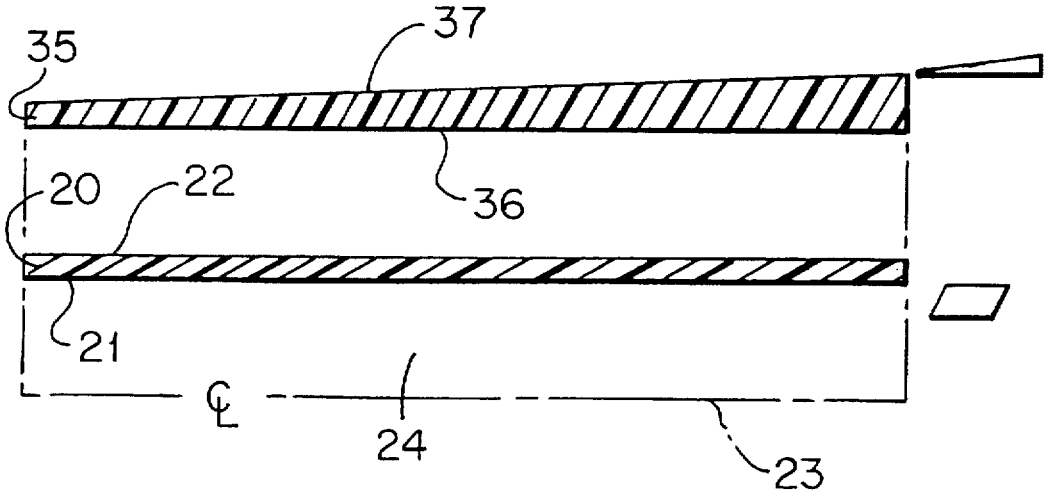
FIG. 8B schematically represents the relative orientations in a second embodiment of the present invention, of the exterior and interior surfaces relative to the rotational axis, which is indicated by the overlapping letters CL and the chain-dashed line.
Figure 8C:
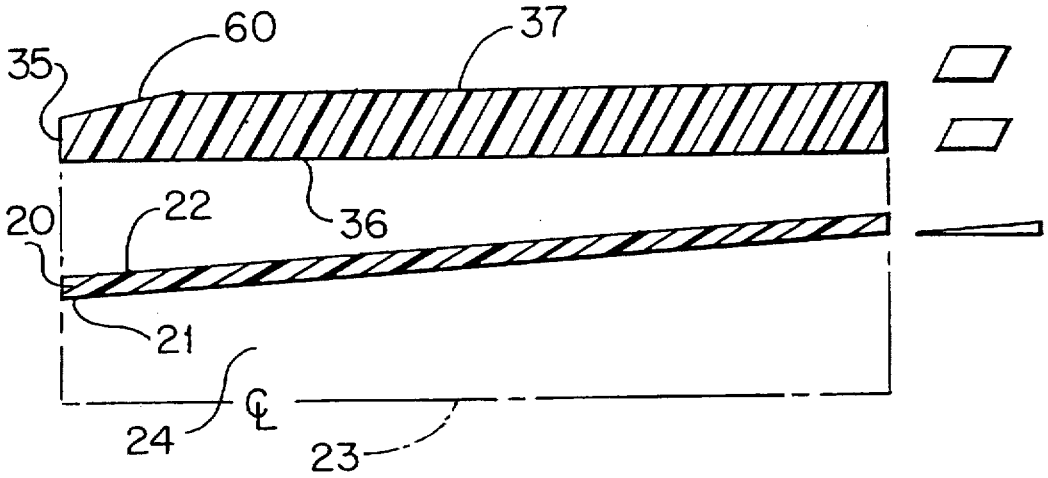
FIG. 8C schematically represents the relative orientations in a third embodiment of the present invention, of the exterior and interior surfaces relative to the rotational axis, which is indicated by the overlapping letters CL and the chain-dashed line.
Figure 8D:
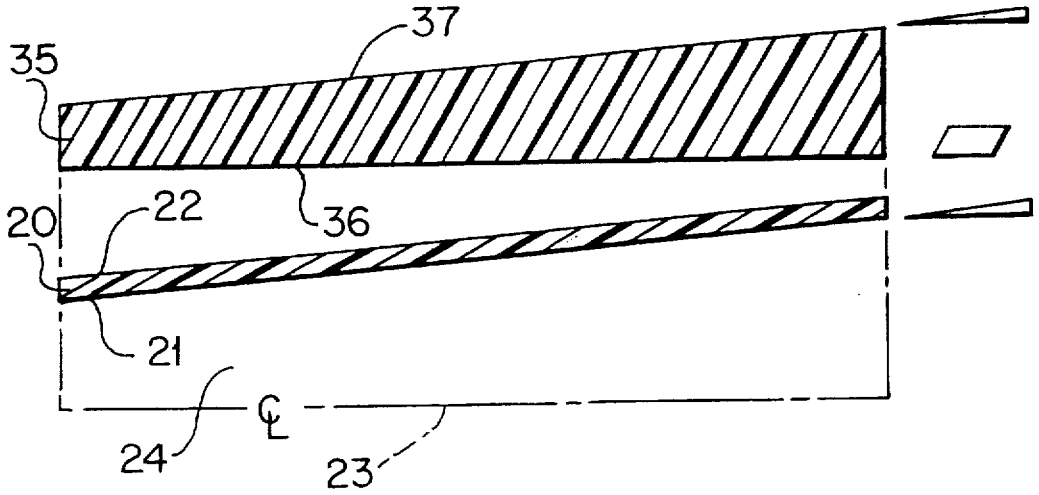
FIG. 8D schematically represents the relative orientations in a fourth embodiment of the present invention, of the exterior and interior surfaces relative to the rotational axis, which is indicated by the overlapping letters CL and the chain-dashed line.

As embodied herein and shown in FIGS. 8A and 8C for example, the diameter of outer surface 37 of outer cylindrical layer is constant along the length thereof, and outer surface 37 is parallel (as schematically indicated by the parallelogram symbol in the right-hand margin) to the rotational axis 23 of the spacer sleeve. As shown in FIGS. 8B and 8D for example, the diameter of outer surface 37 of outer cylindrical layer 35, varies at a constant rate so that outer surface 37 tapers (as schematically indicated by the wedge symbol in the right-hand margin) along the length thereof from the first end of the spacer sleeve to the second end of the spacer sleeve and with respect to the rotational axis 23 of the spacer sleeve.

As shown in FIGS. 8A and 8B for example, the diameter of inner surface 21 of core member 20 is constant along the length thereof, and inner surface 21 is parallel (as schematically indicated by the parallelogram symbol in the right-hand margin) to the rotational axis 23 of the spacer sleeve. As shown in FIGS. 8C and 8D for example, the diameter of inner surface 21 of core member 20, varies at a constant rate so that inner surface 21 tapers (as indicated schematically by the wedge symbol in the right-hand margin) along the length thereof from the first end of the spacer sleeve to the second end of the spacer sleeve and with respect to the rotational axis 23 of the spacer sleeve.

The embodiment of the spacer sleeve schematically shown in FIG. 8A can accommodate a parallel printing sleeve to a parallel printing cylinder. The embodiment of the spacer sleeve schematically shown in FIG. 8B can accommodate a tapered printing sleeve to a parallel printing cylinder. The embodiment of the spacer sleeve schematically shown in FIG. 8C can accommodate a parallel printing sleeve to a tapered printing cylinder. The embodiment of the spacer sleeve schematically shown in FIG. 8D can accommodate a tapered printing sleeve to a tapered printing cylinder.

In accordance with the presently preferred embodiments of the present invention, the spacer sleeve can include a transition layer, which is a cylindrical layer having concentric outer and inner surfaces. The outer surface of the transition layer is disposed against the inner surface of the bridge layer. As shown in FIGS. 3, 7B, 10 and 12 for example, an outer surface 42 of a transition layer 40 is disposed against inner surface 31 of bridge layer 30. In the presently preferred embodiments, the inner surface 41 of transition layer 40 is disposed against the compressible means. In FIG. 10 for example, inner surface 41 is disposed against outer surface 27 of rubber layer 26. In such embodiments, transition layer 40 functions to provide an interface between the compressible means and bridge layer 30. Outer surface 27 of rubber layer 26 would provide an unsuitable interface with inner surface 31 of bridge layer 30. The compressibility of rubber layer 26 would cause deformation in outer surface 27 of rubber layer 26 and result in bridge layer 30 and rubber layer 26 becoming detached at their interface as rubber layer 26 was repeatedly expanded and contracted. Moreover, transition layer 40 is composed of material that more readily adheres to rubber layer 26 than the material that composes the spacer rings 44, 45 or rigid polyurethane foam (FIG. 2) of bridge layer 30. Examples of materials that are suitable for composing the transition layer include one of the group including aramid fiber bonded with epoxy resin or polyester resin, and reinforced polymeric material such as hardened glass fiber bonded with epoxy resin or hardened glass fiber bonded with polyester resin, the latter two also known as fiberglass reinforced epoxy resin or fiberglass reinforced polyester.

In the alternative embodiment shown in FIG. 13B, inner surface 41 of transition layer 40 is disposed against outer surface 22 of core member 20. Thus, transition layer 40 functions to provide an interface between core member 20 and bridge layer 30 (only the lower portion being shown).

In accordance with the present invention, the spacer sleeve includes a means for providing pressurized gas at its outer surface near one of its ends. This gas is typically pressurized air at about 85 pounds per square inch and facilitates the mounting and dismounting of printing sleeves onto and off from, the spacer sleeve. As shown in FIGS. 2, 4, 5, 7B, 9, 10, 11, 12 and 12A for example, the gas provision means can include at least one channel 50. In the presently preferred embodiments, each channel 50 is formed through outer surface 37 of outer cylindrical layer 35. In the embodiment shown in FIGS. 12 and 12A for example, a single channel 50 is provided. In the embodiments shown in FIGS. 2, 4, 5, 7B, 9, 10, and 11 for example, a plurality of channels 50 are provided. Each channel 50 typically measures two (2) millimeters in diameter and is configured to direct the pressurized gas from within the bridge layer 30 and through the outer surface of the spacer sleeve. In embodiments with multiple channels, about eight channels 50 are desirably disposed evenly spaced apart around the circumference of the spacer sleeve near the leading end of the spacer sleeve. As shown in FIGS. 2, 4, 7B, and 10, outer cylindrical layer 35 defines a first free end 38, and channels 50 are disposed in proximity to first free end 38. In alternative embodiments shown in FIGS. 11 and 12, spacer ring 44 defines a first free end 43, and each channel 50 is disposed in proximity to first free end 43 of spacer ring 44.

In the embodiments shown in FIGS. 2, 4, 10, 11 and 12A, the gas provision means also includes a first groove 51 defined with a radially extending depth into the bridge layer 30 and configured to extend circumferentially around bridge layer 30 and in communication with channels 50. First groove 51 is configured and disposed to function as an air distribution manifold that feeds the pressurized gas to all of channels 50. In the embodiments shown in FIGS. 2, 4, 10, 12, and 12A, first groove 51 is configured to extend through the outer surface of bridge layer 30. In the alternative embodiment shown in FIG. 12A, first groove 51 is provided with a radial depth of about 1/16 inch.

In the alternative embodiment shown in FIG. 11, first groove 51 is configured so that it does not extend through the outer surface of bridge layer 30. In the FIG. 11 embodiment, an annular groove is machined circumferentially into free end 43 of spacer ring 44, and an annular plug 61 is secured therein to provide an air tight seal and thereby form first groove 51.

In the alternative embodiment shown in FIGS. 12 and 12A, the printing sleeve that is to be mounted on the spacer sleeve, is forced onto spacer ring 44 until first groove 51 is covered by the printing sleeve. In this condition, first groove 51 becomes enclosed in effect and permits the pressurized gas flowing through the sole channel 50 to travel around groove 51 and be supplied around the entire circumference of the spacer sleeve and evenly distributed between the outer surface of the spacer sleeve and the inner surface of the printing sleeve.

As shown in FIGS. 2, 3, 7B and 10, the gas provision means can include a gas inlet bore 52 defined in the bridge layer and configured to extend axially in the bridge layer. Gas inlet bore 52 is configured with a threaded wall 53 to receive a threaded pressurized gas fitting 54 (FIG. 1) for the provision of pressurized gas from outside the spacer sleeve.

In accordance with the present invention, the gas provision means can further include at least one gas conduit 56 that extends axially through the bridge layer. Preferably, a pair of gas conduits 56 are disposed 180 degrees apart around the circumference of the bridge layer for purposes of ensuring that the spacer sleeve is rotationally balanced. Only one gas conduit 56 needs to be configured to permit passage of pressurized gas from gas inlet bore 52 to channels 50. However, provision can be made to permit both conduits to carry gas.

As shown in FIGS. 9–12 for example, a rigid, hollow tube formed of metal such as aluminum for example or formed of a rigid plastic capable of withstanding the gas pressures involved, desirably can be used to form each gas conduit 56 in a presently preferred embodiment of the invention. In the alternative embodiment shown in FIGS. 2–4 for example, a plastic tube embedded and reinforced in the rigid polyurethane foam forming bridge layer 30 can be used to form each gas conduit 56.

In the alternative embodiment shown in FIGS. 6 and 7B for example, the gas conduit is formed in effect by the region of bridge layer 30 defined between inner surface 36 of outer cylindrical layer 35 and outer surface 42 of transition layer 40. However, transition layer 40 is not as strong as either the metal that forms conduits 56 in the preferred FIG. 10 embodiment or the tubes 56 embedded and reinforced in rigid polyurethane foam in the FIG. 2 embodiment. Because of this difference in strength, this FIG. 7B embodiment should not be pressurized with gas unless mounted on a printing cylinder 13 in order to take advantage of the reinforcement provided by the metallic composition of the printing cylinder. In the alternative embodiment shown in FIG. 6 for example, the gas conduit also includes gas passages 49 through intermediate spacer rings 48.

In the preferred embodiment shown in FIG. 10 for example, each opposite end of gas conduit 56, which has an inside diameter of from about 3/16 to about 1/4 inch, is connected into an axially extending fitting opening 66 defined in each spacer ring 44, 45. Adhesive is desirably used to secure the ends of conduit 56 in an airtight fashion in fitting openings 66. Spacer ring 44 also includes an elbow conduit 67 that has an axial leg 68 parallel to and connected to fitting opening 66. Elbow conduit 67 also has a radially extending leg 69 connected to first groove 51, which forms a gas distribution manifold. Elbow conduit 67 can have an inside diameter of from about 3/16 to about 1/4 inch, which is smaller than the diameter of each of conduit 56 and first groove 51. Moreover, the combined flow area of all of the channels 50 is smaller than the effective flow area of first groove 51, and this relative relationship helps ensure even flow distribution and pressure of the flowing gas to all of the channels 50 disposed around the circumference of the spacer sleeve.

As shown in phantom (dashed line) in FIG. 9, two elbow conduits 67A, 67B are configured in spacer ring 44, the second elbow conduit 67B at a location 180 degrees from the first elbow conduit 67A and aligned with a second fitting opening 66B in order to ensure that the spacer sleeve is rotationally balanced. However, this second elbow conduit 67B need not be connected to the second fitting opening 66B to ensure adequate gas flow to all of the channels 50.

Moreover, in order to obtain the desired rotational balance in the embodiments shown in FIGS. 1–3, 9 and 10 for example, the gas provision means can include a second groove 55 defined in the bridge layer 30 and configured to extend radially into bridge layer 30 from the outer surface 32 thereof and circumferentially around the entire spacer sleeve. Second groove 55 is further configured to communicate with the gas inlet bore 52. As shown in FIG. 2 for example, each gas conduit 56 is configured to permit passage of gas from the second groove 55 to the first groove 51. As shown in FIG. 10 for example, second groove 55 is defined in spacer ring 45 and communicates with the gas inlet bore 52 via a radial leg 69. Similarly, as shown in FIG. 9, second groove 55 communicates with a blind extension 52A of fitting opening 66A in spacer ring 45 via a radial leg 69A. As shown in FIG. 9, second groove 55 permits passage of gas to the first groove 51 via radial leg 69A, extension 52A, fitting opening 66A, gas conduit 56, fitting opening 66B, and elbow conduit 67B.

In the alternative embodiment shown in FIG. 12, the gas provision means includes axial leg 68 defined in spacer ring 44 of bridge layer 30 and connecting fitting opening 66 and conduit 56 to channel 50.

As shown in FIGS. 2, 5, 7B, and 10 for example, outer surface 37 of outer cylindrical layer 35 has a beveled surface part 60 disposed to extend from first free end 38 and toward channels 50. In a similar fashion, as shown in FIGS. 11 and 12, outer surface 32 of spacer ring 44 has a beveled surface part 65 disposed to extend from first free end 43 and toward channels 50. Surface part 60, 65 is inclined to the rest of outer surface 37 of outer cylindrical layer 35 so as to form a lead-in for mounting the printing sleeve 15 onto outer surface 37 of outer cylindrical layer 35.

EXAMPLE 1

This hypothetical example is provided to illustrate how to make a presently preferred embodiment of the spacer sleeve of the invention. To make the core member 20, a rotatable, metallic forming mandrel is used with an outside surface having a cylindrical shape that is the mirror image of the desired shape of the inner surface 21 of the core member. For example, if the inner surface of the core member is to be formed as a right cylinder, as schematically indicated by the adjacent parallelograms in FIGS. 8A and 8B for example, then the forming mandrel's cross-section taken in a direction that is perpendicular to the rotational axis of the mandrel, is a circle of constant diameter over the entire length of the mandrel. If the shape is a taper, then the axial cross-section is a conical section.

In order to configure the inner surface 21 of the core member 20 with an interference fit for the intended printing cylinder 13, the forming mandrel is selected with an outside diameter that is in a range of from about 0.002 inches to 0.004 inches less than the diameter of the printing cylinder for which the finished spacer sleeve is intended. The particular diameter selected in this range, depends on the size of the spacer sleeve to be formed. The smaller the diameter of the spacer sleeve, the smaller the interference fit, since there will be less area available for expansion.

In this illustrative example, a flat tape about one inch wide and formed of woven fiberglass is passed through a bath of epoxy resin and then wound around the mandrel. The dipped fiberglass tape is wound around the mandrel from a first end of the mandrel to the opposite second end of the mandrel. When proceeding from the first end to the second end, the resin-carrying fiberglass tape is wound at an acute angle to the rotational axis of the mandrel. Considering the rotational axis of the mandrel at the first end of the mandrel to be 0° and the second end of the mandrel at the rotational axis to be 180°, this winding angle from the first end to the second end is on the order of 80° (90° and 270° being perpendicular to the rotational axis of the mandrel). Before the winding of the tape proceeds from the second end back to the first end of the mandrel, a change is made to the angle at which the resin-dipped tape is wound. This winding angle is changed so as to form a crossing angle (100°) that deviates from the 90° direction by the same amount as the first pass from the first end of the winding mandrel to the second end. Thus, the winding angles deviate by 10° above and below the 90° direction.

After the winding of the dipped tape proceeds from the second end back to the first end of the mandrel, the tape is cut. Then, fiberglass strands are passed through a bath of epoxy resin before being wound around the mandrel at the same angle as the angle during the first pass of the tape from the first end of the mandrel to the opposite second end of the mandrel. When the dipped fiberglass strands reach the second end, the angle at which the resin-dipped fiberglass strands are wound is changed to the same angle at which the second pass of the resin-carrying fiberglass tape was wound, and the winding of the dipped fiberglass strands proceeds from the second end back to the first end of the mandrel. These back and forth passes of dipped fiberglass strands are repeated until enough windings are applied so as to form a core of fiberglass reinforced resin with a radial thickness in the range of from 1.0 mm to 2.5 mm.

Then, the mandrel and the fiberglass reinforced resin core still wound around the mandrel, are placed in an hot air oven for several hours at a temperature of 176° F. to polymerize the core into a fiberglass reinforced polymeric precursor tube. Then the mandrel carrying the tube is removed from the oven and allowed to cool to ambient temperature. The tube has then become the core member 20 of the spacer sleeve. The outer surface 22 of core member 20 is rough and uneven due to the presence in the outer surface 22 of partially and randomly protruding epoxy-coated, fiberglass strands. When removed from the forming mandrel, the inside surface of the relaxed, i.e., unexpanded, core member has a diameter that is about 0.002 inches to 0.004 inches less than the diameter of the printing cylinder for which the spacer sleeve is intended. Thus, the interference fit between the outside diameter of the printing cylinder and the inside diameter of the spacer sleeve is in the range of about 0.002 to 0.004 inches.

In this first example, a compressible means is formed by applying extruded elastomeric rubber material around the rough and uneven outer surface 22 of the core member 20. The sleeve composed of the core member 20 and the extruded elastomeric rubber material is placed in an autoclave at a temperature above 300° F. for several hours until the rubber layer 26 has been cured. The outermost surface 27 of the rubber layer 26 is then ground and finished to become smooth and cylindrical and concentric with the cylindrical inner surface 21 of the core member 20. The finished rubber layer 26 has a radial thickness that is up to one quarter inch thick.

In this first embodiment, a transition layer 40 covers the outermost surface 27 of the rubber layer 26. This transition layer 40 is formed and composed in the same manner as the core member 20 described above except that the initial winding of epoxy bathed tape occurs around the outer surface 27 of rubber layer 26.

As shown in FIGS. 9 and 10 for example, a first spacer ring 44 and a second spacer ring 45 are cut and machined from an aluminum cylinder. Each spacer ring 44, 45 has an axial thickness of about three (3) inches. Spacer ring 44 is configured with a first groove 51 disposed radially around the outer circumference. Spacer ring 44 is further configured with a pair of fitting openings 66 disposed axially in the inner side surface of ring 44 and disposed 180 degrees apart. An elbow conduit 67 is formed to connect each fitting opening 66 to groove 51.

As shown in FIG. 10, spacer ring 45 is configured with a gas inlet bore 52 defined to extend axially from the outer side surface of ring 45 and having a threaded wall 53 to receive a threaded pressurized gas fitting 54. Spacer ring 45 is further configured with a pair of fitting openings 66 disposed axially in the inner side surface of spacer ring 45 and disposed 180 degrees apart. At least one fitting opening 66 in ring 45 is connected to inlet bore 52.

As each spacer ring 44, 45 is glued onto outer surface 42 of transition layer 40 at each free end thereof, a pair of aluminum tubes 56 are glued into the fitting openings 66 of spacer rings 44, 45. A suitable adhesive for these purposes is supplied by Angst & Pfister under the PERMABOND E 32 trademark. Each gas conduit 56 is configured with an internal diameter of about one quarter inch.

Thereafter, an outer cylindrical layer 35 is prepared on a forming mandrel in much the same fashion as described for the preparation of core member 20, with the following exceptions. First, outer cylindrical layer 35 is to be attached to spacer rings 44, 45 in a line-to-line fit, and so the diameter of the forming mandrel is the same as the outside diameter of the spacer rings 44, 45. Second, carbon fibers are substituted for fiberglass strands. Third, the angle at which the carbon fibers are laid is parallel to the axis of rotation rather than substantially transversely thereto. Fourth, outer layer 35 is stress-relieved before being attached to the spacer sleeve.

The outer surfaces 32 of the spacer rings 44, 45 are prepared with adhesive 46 (as shown in FIG. 5 for example), and then the outer cylindrical layer 35 is slid over the outer surfaces 32 in a line-to-line fit therewith. Once the adhesive sets and connects outer cylindrical layer 35 to spacer rings 44, 45 and possibly 48, the outer surface 37 of outer cylindrical layer 35 is finished to almost the desired thickness of the spacer sleeve 210. About eight channels 50 are drilled radially through outer cylindrical layer 35 SO as to communicate with first groove 51 in spacer ring 44. The spacer sleeve 210 is then air-mounted on a mock printing cylinder, and the outer surface 37 is finished to become smooth and cylindrical and concentric with the cylindrical inner surface 21 of the core member 20 of the spacer sleeve. This final finishing of outer surface 37 is performed to the desired thickness for the intended printing sleeve that is to be mounted on the spacer sleeve and to a sufficient uniformity such that the combined TIR of the spacer sleeve and a thin sleeve mounted thereon with printing plates, is less than 0.0015 inches. After this finishing step, this embodiment of the spacer sleeve is completed.

To operate this embodiment of the spacer sleeve 210, a printing cylinder 13 that is provided with a facility for dispensing pressurized air through outer surface 12 thereof via air escape holes (not shown) is fitted with the spacer sleeve. As shown in FIG. 10, one end of the outer surface 12 of printing cylinder 13 is provided with a beveled surface 19 and initially receives one end of the spacer sleeve 210 thereon. Near that same end of the printing cylinder, the air escape holes 25 are provided. The spacer sleeve 210 is slid onto the outer surface 13 of the printing cylinder 12 until the air escape holes 25 are covered by the spacer sleeve. Then the pressurized air is supplied to the air escape holes in the printing cylinder 13, having the effect of expanding the inner surface 21 of core member 20 of the spacer sleeve 210 sufficiently to easily slide the remaining length of the spacer sleeve onto the outer surface of the printing cylinder.

As the core member expands diametrically, the rubber layer 26 is compressed between outer surface 22 of core member 20 and inner surface 41 of transition layer 40. The compression of rubber layer 26 results in radial compression thereof and axial elongation thereof so that rubber layer 26 expands axially toward first free end 43 of spacer ring 44 and the outer side surface of spacer ring 45.

Once the entire spacer sleeve 210 is positioned symmetrically onto printing cylinder 13, the pressurized air is discontinued. Whereupon, the inner surface 21 of core member 20 contracts to apply a tight fit about outer surface 12 of printing cylinder 13. In this way, the spacer sleeve 210 becomes torsionally rigidly mounted on the outer surface 12 of the printing cylinder 13. In other words, there is no slippage between the outer surface 12 of the printing cylinder 13 and the inner surface 21 of the spacer sleeve's core member 20.

A printing sleeve 15 carrying an attached printing plate 16, is slid onto the end of the spacer sleeve 210 having the beveled surface part 60 near the free end thereof. The printing sleeve 15 is slid until it covers channels 50 in the outer cylindrical layer 35. A pressurized gas fitting 54 is attached to gas inlet 52 as shown in FIG. 1 for example. Pressurized air is provided through fitting 54 into gas inlet bore 52. The pressurized air travels through at least one conduit 56 and elbow conduit 67 and fills first groove 51. The pressurized gas then escapes through channels 50 and allows the inner surface 14 of the printing sleeve 15 to be slid entirely onto outer surface 37 of the spacer sleeve 210. Whereupon the pressurized air is discontinued, and the gas fitting 54 is disconnected from gas inlet 52.

Upon cessation of the pressurized air through channels 50 the inner surface 14 of the printing sleeve 15 contracts so as to grip outer surface 37 of the spacer sleeve 210 in a manner that results in printing sleeve 15 becoming torsionally locked to the spacer sleeve. After the printing job is completed, and a different sleeve is to be mounted on the spacer sleeve, the gas fitting 54 can be reconnected to gas inlet 52. Pressurized gas is again supplied as discussed above when the printing sleeve 15 was being mounted onto the spacer sleeve 210. Similarly, the inner surface 14 of the printing sleeve is slid entirely off of the outer surface 37 of spacer sleeve 210.

Similarly, spacer sleeve 210 can be removed by reversing the process by which the spacer sleeve was mounted onto the printing cylinder. Moreover, it is possible to remove spacer sleeve 210 while retaining the printing sleeve on the spacer sleeve, if desired. A spacer sleeve 210 that is already carrying a printing sleeve, can be mounted onto the printing cylinder in the same fashion as if there were no printing sleeve already mounted on the spacer sleeve.

EXAMPLE 2

This second example proceeds like Example 1 through the transition layer 40. Next, as shown in FIG. 2, a length of ¼ inch diameter hollow nylon tubing 56 measuring about two inches shorter than the desired length of the spacer sleeve, is placed axially along the length of the transition layer 40 and centered equidistant from each free end of the transition layer, before being taped in place. A second identical nylon tube 56 is similarly taped to the unfinished exterior surface 42 of the transition layer at a circumferential location that is 180° from the first tube.

The coarse outermost surface of the transition layer 40 and the two nylon tubes taped thereon, are then surrounded by a bridge layer 30 composed of rigid, open cell polyurethane foam. This is accomplished by heating a steel mold in an oven to a temperature of about 104° F. The mold is then removed from the oven, and the sleeve composed of the core member 20, the rubber layer 26, the transition layer 40, and the nylon tubes, are place into the heated mold. Then a liquid polyurethane composition is injected into the heated mold where it surrounds the sleeve and is allowed to cool for 12 hours to ambient temperature. The sleeve now has an exterior layer of rigid, open cell polyurethane foam and is removed from the mold.

The rigid polyurethane foam layer is ground to the desired thickness, which is determined depending on the outer diameter of the intended printing cylinder and the inner diameter of the intended printing sleeve, and becomes the bridge layer 30. The outermost surface 32 of the bridge layer 30 is finished to become cylindrical and concentric with the cylindrical inner surface 21 of the core member 20.

About one inch from a first end of the bridge layer, a circumferentially extending groove 51 measuring three eighths of an inch (⅜") wide in the axial direction, is milled through the radial thickness of the bridge layer 30. As shown in FIG. 2 for example, the depth of groove 51 is deep enough so as to remove a section of the wall of the nylon tubes 56 and form a slot 57 therein. A second groove 55 is similarly formed about one inch from the second end of the bridge layer 30. The upper portion of each groove 51, 55 is widened as shown in FIG. 3 for example, to a depth of about one third of the thickness of the bridge layer. This results in a countersunk surface 58 for each groove. A ring clip 62 formed of fiberglass reinforced polymeric material is inserted into the countersunk portion of each groove 51, 55 as a shield to protect slots 57 in the walls of the nylon tubes from becoming clogged during the next step in the manufacturing process. As shown in FIG. 2 for example, the exterior diameter of each ring clip 62 is slightly smaller than the exterior diameter of the bridge layer 30.

An outer cylindrical layer 35 is formed by a final layer of carbon fiber reinforced polymeric material. As shown in FIG. 3 for example, the layer 35 of carbon fiber reinforced polymeric material is applied to cover the outermost surface 32 of the bridge layer 30, the exposed sidewall surfaces 59 of the countersunk portions of the grooves 51, 55, and the outer surfaces 63 of the ring clips 62. Note in FIGS. 1–4 that the carbon fiber reinforced polymeric material also extends to cover the first and second ends of the bridge layer 30 and the edge of the transition layer 40. In so doing, there is formed a first free end 38 (FIG. 4) of outer cylindrical layer 35 and a second free end 39 (FIG. 3) of outer cylindrical layer 35. This carbon fiber reinforced polymeric layer 35 is formed in a similar manner as core member 20 is formed as described above, except that carbon fibers are used instead of fiberglass strands. Thus, the sleeve with the uncured resin and carbon fibers wound around the outermost surface 32 of the bridge layer 30 of rigid polyurethane foam and the outer surface 63 of ring clips 62, are placed in an hot air oven for several hours at a temperature of 176° F. to polymerize the carbon fiber reinforced polymeric layer. The outer cylindrical layer 35 is formed by grinding the carbon fiber reinforced polymeric layer to almost the desired thickness.

As shown in FIGS. 1–3 for example, a gas inlet bore 52 is formed by drilling a passage axially through second free end 39 of outer cylindrical layer 35 and into one end of the bridge layer 30 so as to communicate with second circumferential groove 55. This passage is then threaded internally so as to threadingly receive a pressurized gas fixture 54 as shown in FIG. 1. Near the end of the spacer sleeve that is opposite the end where the axial gas inlet bore 52 is drilled, eight channels 50 terminating in air escape holes, each measuring 2 mm in diameter, are radially drilled through the outer cylindrical layer 35 disposed above first groove 51. Each channel 50 is drilled through the underlying ring clip 62 to communicate with the first circumferential groove 51. The eight channels 50 are equally spaced apart around the circumference of the spacer sleeve.

The spacer sleeve is mounted (using air pressure to expand the inside diameter of the core member) on a mock printing mandrel of the size for which the finished sleeve is intended. The spacer sleeve so mounted, has the outer surface 37 of its outer cylindrical layer 35, finished to become smooth and cylindrical and concentric with the cylindrical inner surface 21 of the core member of the spacer sleeve. After this finishing step, this embodiment of the spacer sleeve is completed. However, the preferred embodiment with the bridge layer formed of spacer rings 44, 45 as in Example 1, appears to yield a better run out tolerance than this Example 2 embodiment with the bridge layer formed of rigid polyurethane.

EXAMPLE 3

Construction of a third hypothetical embodiment of a spacer sleeve 111 shown in FIGS. 5–7B for example, proceeds in the identical fashion as described in Example 1 for each of the core member 20, rubber layer 26, and transition layer 40. Then a spacer ring 44, 45 is glued onto outer surface 42 of transition layer 40 at each free end thereof, resulting in the assembly shown in FIGS. 5 and 6 for example. Depending upon the axial length of the spacer sleeve 111 being constructed, one or more intermediate spacer rings 48 may need to be glued along the length of the spacer sleeve between the two spacer rings 44, 45 disposed at each end of the spacer sleeve. Moreover, each of the intermediate spacer rings 48 must be provided with a plurality of gas passages 49 therethrough in order to permit the passage of pressurized gas from the gas inlet 52 (FIG. 7B) to air channels 50, as described hereafter.

Thereafter, an outer cylindrical layer 35 is prepared and attached to the spacer rings 44, 45 in the same fashion as described for Example 1. The outer cylindrical layer 35 is also finished and the air channels 50 formed in the same fashion as described for Example 1.

Use of this embodiment of the spacer sleeve proceeds in much the same fashion as the embodiment described above in Example 1. The main difference is the path taken by the pressurized air that enters via gas inlet 52. In this embodiment shown in FIG. 7B for example, the pressurized gas that enters gas inlet 52, proceeds to channels 50 without passing through tubing 56. If intermediate spacer rings 48 are required, the pressurized gas passes through the gas passages 49 formed therein.

While preferred embodiments of the invention have been described using specific terms, such description is for illustrative purposes only, and it is to be understood that changes and variations may be made without departing from the spirit or scope of the following claims.

What is claimed is:

1. A spacer sleeve for being torsionally rigidly mounted on a rotogravure or flexographic printing cylinder that is to be rotated about its axis when used in a printing machine and for torsionally rigidly supporting on an outer surface of the spacer sleeve, a printing sleeve that carries printing matrices, wherein the spacer sleeve has three operational modes such that in a first mode the spacer sleeve can be selectively air-mounted onto the printing cylinder and unmounted from the printing cylinder, in a second mode the printing sleeve can be selectively air-mounted onto the spacer sleeve and unmounted from the spacer sleeve, in a third mode the printing sleeve can be torsionally locked to the spacer sleeve, wherein the spacer sleeve has a first end and a second end disposed axially opposite the first end, the spacer sleeve comprising:

an elongated core member having a generally cylindrical shape, said core member having a cylindrical inner surface defining a hollow internal region, said core member having a central rotational axis disposed in said hollow region, said inner surface of said core member defining a diameter at each point along the length thereof in a direction transverse to said rotational axis, said core member being formed of diametrically expandable, high rigidity material, and said core member having a cylindrical outer surface;

a compressible means for mechanically absorbing radial expansion of said core member, said compressible means having an inner surface disposed against said cylindrical outer surface of said core member, said compressible means having an outer surface disposed to face away from said core member;

a bridge layer having generally cylindrical shape, said bridge layer having an inner surface disposed to face toward said outer surface of said compressible means, said bridge layer being formed of incompressible material and having an outer surface disposed to face away from said compressible means;

an outer cylindrical layer formed of high rigidity material and defining an inner surface and an outer surface, said inner surface of said outer cylindrical layer being disposed against said bridge layer; and a means for providing pressurized gas at the outer surface of the spacer sleeve.

2. A spacer sleeve as in claim 1, wherein said bridge layer is defined by at least a first spacer ring and a second spacer ring spaced axially apart from said first spacer ring, each said spacer ring having an outer surface disposed to support said inner surface of said outer cylindrical layer, each said spacer ring having an inner surface disposed toward said core member.

3. A spacer sleeve as in claim 2, wherein said gas provision means includes a plurality of channels, each said channel being configured to direct gas from within said bridge layer and to the outer surface of the spacer sleeve.

4. A spacer sleeve as in claim 3, wherein said gas provision means includes a first groove defined in said bridge layer and configured to extend circumferentially and communicate with said channels.

5. A spacer sleeve as in claim 4, wherein said gas provision means includes a gas inlet bore defined in said bridge layer and configured to extend axially therein and receive a pressurized gas fitting for the provision of pressurized gas.

6. A spacer sleeve as in claim 5, wherein said gas provision means includes at least one gas conduit, each said gas conduit being disposed in said bridge layer and extending axially therein and configured to permit passage of gas from said gas inlet to said first groove.

7. A spacer sleeve as in claim 6, wherein said gas conduit is a rigid tube extending between said spacer rings.

8. A spacer sleeve as in claim 3, wherein said channels are defined through said outer cylindrical layer.

9. A spacer sleeve as in claim 3, wherein said channels are defined through said first spacer ring.

10. A spacer sleeve as in claim 9, wherein said gas provision means includes a first groove defined through said first spacer ring and configured to extend circumferentially and communicate with said channels.

11. A spacer sleeve as in claim 9, wherein said gas provision means includes a first groove defined through said outer surface of said first spacer ring and configured to extend circumferentially and communicate with said channels.

12. A spacer sleeve as in claim 1, wherein said bridge layer is formed of expanded rigid polyurethane.

13. A spacer sleeve as in claim 1, further comprising:

a transition layer having a cylindrical inner surface disposed against said compressible means and having an outer surface disposed against said inner surface of said bridge layer.

14. A spacer sleeve as in claim 13, wherein said transition layer is composed of material that includes one of the group consisting of aramid fibre bonded with epoxy resin, aramid fibre bonded with polyester resin, hardened glass fibre bonded with epoxy resin, hardened glass fibre bonded with polyester resin, carbon fibre bonded with epoxy resin, and carbon fiber bonded with polyester resin.

15. A spacer sleeve as in claim 1, wherein said core member is composed of material that includes one of the group consisting of graphite impregnated plastics, urethane of grade greater than 75 shore A, aramid fibre bonded with epoxy resin, aramid fibre bonded with polyester resin, hardened glass fibre bonded with epoxy resin, hardened glass fibre bonded with polyester resin, hardened carbon fibre bonded with epoxy resin, and hardened carbon fibre bonded with polyester resin.

16. A spacer sleeve as in claim 1, wherein said outer surface of said outer cylindrical layer being configured to a tolerance capable of supporting a printing sleeve thereon, and said outer surface of said outer cylindrical layer defining a diameter at each point along the length thereof in a direction transverse to said rotational axis.

17. A spacer sleeve as in claim 16, wherein said diameter of said outer surface of said outer cylindrical layer is constant along the length thereof.

18. A spacer sleeve as in claim 16, wherein said diameter of said outer surface of said outer cylindrical layer, varies at a constant rate so that said outer surface tapers along the length thereof from the first end of the spacer sleeve to the second end of the spacer sleeve.

19. A spacer sleeve as in claim 1, wherein said diameter of said inner surface of said core member is constant along the length thereof.

20. A spacer sleeve as in claim 1, wherein said diameter of said inner surface of said core member, varies at a constant rate so that said inner surface tapers along the length thereof from the first end of the spacer sleeve to the second end of the spacer sleeve.

21. A spacer sleeve as in claim 1, wherein said outer cylindrical layer is composed of material that includes one of the group consisting of aluminum, steel, aramid fiber bonded with epoxy resin, aramid fiber bonded with polyester resin, hardened glass fiber bonded with epoxy resin, hardened glass fiber bonded with polyester resin, carbon fiber bonded with epoxy resin, and carbon fiber bonded with polyester resin.

22. A spacer sleeve for being torsionally rigidly mounted on a rotogravure or flexographic mandrel that is to be rotated about its axis when used in a printing machine and for torsionally rigidly supporting by an interference fit on an outer surface of the spacer sleeve, a printing sleeve that carries printing matrices, wherein the spacer sleeve has three operational modes such that in a first mode the spacer sleeve can be selectively air-mounted onto the printing cylinder and unmounted from the printing cylinder, in a second mode the printing sleeve can be selectively air-mounted onto the outer surface of the spacer sleeve and unmounted from the outer surface of the spacer sleeve, in a third mode the printing sleeve can be torsionally locked to the outer surface of the spacer sleeve, wherein the spacer sleeve has a first end and a second end disposed axially opposite the first end, the spacer sleeve comprising:

an elongated core member having a generally cylindrical shape, said core member having a cylindrical inner surface defining a hollow internal region, said core member having a central rotational axis disposed in said hollow region, said inner surface of said core member defining a diameter at each point along the length thereof in a direction transverse to said rotational axis, said core member being formed of diametrically expandable, high rigidity material, and said core member having a cylindrical outer surface;

a compressible means for mechanically absorbing radial expansion of said core member, said compressible means having an inner surface disposed against said cylindrical outer surface of said core member, said compressible means having an outer surface disposed to face away from said core member;

a bridge layer having generally cylindrical shape, said bridge layer having an inner surface disposed to face toward said outer surface of said compressible means, said bridge layer being formed of incompressible material and having an outer surface disposed to face away from said compressible means;

a transition layer having a cylindrical inner surface disposed against said compressible means and having an outer surface disposed against said inner surface of said bridge layer;

an outer cylindrical layer formed of high rigidity material and defining an inner surface and an outer surface, said inner surface of said outer cylindrical layer being disposed against said bridge layer, wherein said outer surface of said outer cylindrical layer being configured to a tolerance capable of supporting a printing sleeve thereon, and said outer surface of said outer cylindrical layer defining a diameter at each point along the length thereof in a direction transverse to said rotational axis;

a means for providing pressurized gas at the outer surface of the spacer sleeve, said gas provision means including:

a plurality of channels, each said channel being configured to direct gas from within said bridge layer and through the outer surface of the spacer sleeve, a first groove defined in said bridge layer and configured to extend circumferentially and communicating with each said channel, a gas inlet bore defined in said bridge layer and configured to extend axially therein and receive a pressurized gas fitting for the provision of pressurized gas, a second groove defined in said bridge layer and configured to extend circumferentially and communicating with said bore, and at least one gas conduit, each said gas conduit being disposed in said bridge layer and extending axially therein and configured to permit passage of gas from said second groove to said first groove.

* * * * *